United States Patent [19]

Arikawa

[11] Patent Number: 5,020,787

[45] Date of Patent: Jun. 4, 1991

[54] BILL PROCESSING APPARATUS

[75] Inventor: Junichi Arikawa, Kawaguchi, Japan

[73] Assignee: Laurel Bank Machines Co., Ltd., Tokyo, Japan

[21] Appl. No.: 347,909

[22] Filed: May 5, 1989

[30] Foreign Application Priority Data

May 6, 1988 [JP] Japan ..... 63-110029
Jan. 24, 1989 [JP] Japan ..... 1-104154

[51] Int. Cl.[5] ..... B65H 83/00

[52] U.S. Cl. ..... 271/3; 271/4; 414/789.9; 414/790.2

[58] Field of Search ..... 271/3, 3.1, 4, 6, 7, 271/10, 225, 163; 414/789.9, 790.2, 790.7, 783; 109/48; 902/9, 12, 14

[56] References Cited

U.S. PATENT DOCUMENTS 4,431,178 2/1984 Kokubo et al. ..... 271/187

FOREIGN PATENT DOCUMENTS 58-2970 1/1983 Japan .
60-251487 12/1985 Japan .
1463801 2/1977 United Kingdom .
1488927 10/1977 United Kingdom .
2149175 6/1985 United Kingdom .

*Primary Examiner*—David H. Bollinger
*Attorney, Agent, or Firm*—Fleit, Jacobson, Cohn, Price, Holman & Stern

[57] ABSTRACT

A bill processing apparatus capable of receiving and/or dispensing bills, the bill processing apparatus including a drum disposed in the vicinity of a bill transaction opening capable of communicating between the outside and inside of the bill processing apparatus and secured to a center shaft rotatably mounted on the bill processing apparatus, the drum having a bill accumulating portion which has an opening at one side thereof and can receive the bills via said opening and accumulate them therein, a bill feed-in passage for feeding the bills from the bill accumulating portion into the inside of the bill processing apparatus, a bill feed-out passage for feeding the bills from the inside of the bill processing apparatus to the bill accumulating portion, a drum rotating devices for rotating the drum so that the opening of the bill accumulating portion can selectively communicate with the bill transaction opening, the bill feed-in passage or the bill feed-out passage, and bill transporting rollers provided for the bill accumulating portion and capable of feeding the bills into the bill accumulating portion and feeding out the bills from the bill accumulating portion. The thus constituted bill processing apparatus can be made small in size.

6 Claims, 13 Drawing Sheets

BILL PROCESSING APPARATUS

BACKGROUND OF THE INVENTION

The present invention relates to bill processing apparatuses such as bill receiving machines, bill dispensing machines and bill receiving and dispensing machines for use at for banks etc. and, particularly, to such apparatuses capable of receiving bills and/or dispensing bills.

DESCRIPTION OF THE PRIOR ART

In bill receiving machines used at banks etc., after bills received by the machines have been counted and their genuineness discriminated, unacceptable bills are returned to a first return opening, while acceptable bills are accumulated on a bill accumulating plate by an accumulating wheel at a bill accumulating portion. The accumulated bills are further transported and selectively fed to a return passage communicating with a second return opening or a receiving passage communicating with a bill receiving box by a switching fork in such a manner that should the customer wish all the bills he put into the machine to be returned because, for example, of a disagreement between the value of the bills counted by the machine and the amount of the customer intended to deposit, the bills are fed to the return passage and that should the customer wish all the bills to be received by the machine, the bills are fed to the receiving passage.

However, the structure of a bill receiving machine having a bill accumulating portion and a separately provided switching means for selectively feeding the accumulated bills to the return passage or the receiving passage, is inevitably complicated and has to be provided with a relatively long following the bill accumulation portion, whereby it is extremely difficult to make the bill receiving machine simple in structure and small in size.

Further, as disclosed in U.S. Pat. No. 4,431,178, in bill dispensing machines used at banks etc., bills to be dispensed are taken out one by one from bill dispensation boxes which bills having different denominations. After the bills have been counted, their genuineness confirmed and double feed of bills discriminated, they are accumulated by an accumulating wheel at a bill accumulating portion. The accumulated bills are further transported and selectively fed to a collecting passage communicating with a bill collecting box or a dispensation passage communicating with a bill dispensation opening by a switching fork in such manner that when double feed of bills, the presence of bills having a different denomination from the predetermined one or other abnormality is detected, the bills are fed to the collecting passage and when no abnormality is detected, the bills are fed to the dispensation opening.

However, the structure of a bill dispensing machine having a bill accumulating portion and a separately provided switching means for selectively feeding the accumulated bills to the collecting passage or the dispensation passage, is inevitably complicated and has to be provided with a relatively long passage following the bill accumulation portion, whereby it is extremely difficult to make the bill dispensing machine simple in structure and small in size.

Moreover, bill receiving and dispensing machines capable of receiving and dispensing bills are merely constituted by combining the mechanism of the above described bill receiving machine and that of the above described bill dispensing machine and, therefore, the structure thereof is inevitably more complicated, whereby it is extremely difficult to make the bill receiving and dispensing machine compact.

In order to solve the above described problems, unexamined Japanese Patent Publication No. 58 (1983)-2970 proposes a bill receiving and dispensing machine comprising a rotatable drum having a bill holding portion formed by a pair of plates for holding bills therein and disposed in the vicinity of a bill receiving and dispensing opening and a drum rotating means for rotating the drum so that the bill holding portion of the drum selectively communicates with the bill receiving and dispensing opening, a bill feed-in passage for feeding the received bills into the machine, a counterfeit bill return passage for returning bills which have been discriminated as counterfeit and temporarily accumulated at a first bill accumulating portion to the bill receiving and dispensing opening, a bill dispensing passage for feeding bills for dispensation which have been fed out from a bill dispensation box and temporarily accumulated at a second bill accumulating portion, a bill storage passage for feeding bills which customers have failed to take out from the bill receiving and dispensing opening to a bill storage box via the bill holding portion, or a bill collecting passage for collecting bills which have been fed from the bill dispensation box to the bill receiving and dispensing opening via the bill holding portion, in the case where there is detected an error in the counting of bills taken out from the bill dispensation box.

Further, unexamined Japanese Patent Publication No. 60 (1985)-251487 proposes a bill receiving and dispensing machine comprising a rotatable drum having a bill holding portion formed by a pair of plates for holding bills therein and disposed in the vicinity of a bill receiving and dispensing opening and a drum rotating means for rotating the drum so that the bill holding portion of the drum selectively communicates with the bill receiving and dispensing opening, a bill feed-in passage for feeding the received bills into a bill counting and discriminating means for counting the received bills, confirming their genuineness and discriminating double feed of bills, a bill rediscrimination passage for returning the bills which have been discriminated as unacceptable by the bill counting and discriminating means and temporarily accumulated at a first bill accumulating portion to the bill holding portion for making discrimination of bills again, a counterfeit bill return passage for returning counterfeit bills which have been finally discriminated as unacceptable and temporarily accumulated at the first bill accumulating portion to the bill receiving and dispensing portion, a bill dispensing passage for feeding bills for dispensation which have been fed out from a bill dispensation box containing acceptable received bills and temporarily accumulated at a second bill accumulating portion, or a bill storage passage for feeding bills which customers have failed to take out from the bill receiving and dispensing opening to a bill storage box via the bill holding portion.

According to these bill receiving and dispensing machine, since the drum rotates as occasion demands so as to communicate with one of the passages communicating with the respective portions of the machine, it becomes possible to selectively feed bills to one of the portions of the machine and selectively receive bills from one of the portions of the machine with a simpler structure than that of the prior art bill receiving and dispensing machine, thereby to make the bill receiving and dispensing machine more compact.

However, even in these bill receiving and dispensing machines, since the bill accumulating portion for accumulating the received bills and the bill accumulating portion for accumulating the bills to be dispensed are still provided independently of a bill receiving and feeding means for selectively receiving bills from one of the portions of the machine and selectively feeding bills to one of the portions of the machine, it is impossible to make the bill receiving and dispensing machine sufficiently compact, and if the above described mechanism is applied to the bill receiving machine or the bill dispensing machine, it is again impossible to make the bill receiving machine or the bill dispensing machine sufficiently compact.

SUMMARY OF THE INVENTION

It is, therefore, an object of the present invention to provide a bill processing apparatus capable of receiving and/or dispensing bills which can be made sufficiently compact.

According to the present invention, the above and other objects can be accomplished by a bill processing apparatus capable of receiving and/or dispensing bills, said bill processing apparatus comprising drum means disposed in the vicinity of a bill transaction opening capable of communicating between the outside and inside of the bill processing apparatus and secured to a center shaft rotatably mounted on said bill processing apparatus, said drum means having a bill accumulating means which has an opening at one side thereof and can receive bills via said opening and accumulate them therein, bill feed-in passage means for feeding bills from said bill accumulating means into the inside of the bill processing apparatus, bill feed-out passage means for feeding bills from the inside of the bill processing apparatus to said bill accumulating means, drum rotating means for rotating said drum means so that said opening of said bill accumulating means can selectively communicate with the bill transaction opening, the bill feed-in passage means or the bill feed-out passage means, and bill transporting means provided for said bill accumulating means and capable of feeding bills into said bill accumulating means and feeding out bills from said bill accumulating means.

The above and other objects and features of the present invention will become apparent from the following description made with reference to the accompanying drawings.

DESCRIPTION OF THE PREFERRED EMBODIMENTS

Figure 1:
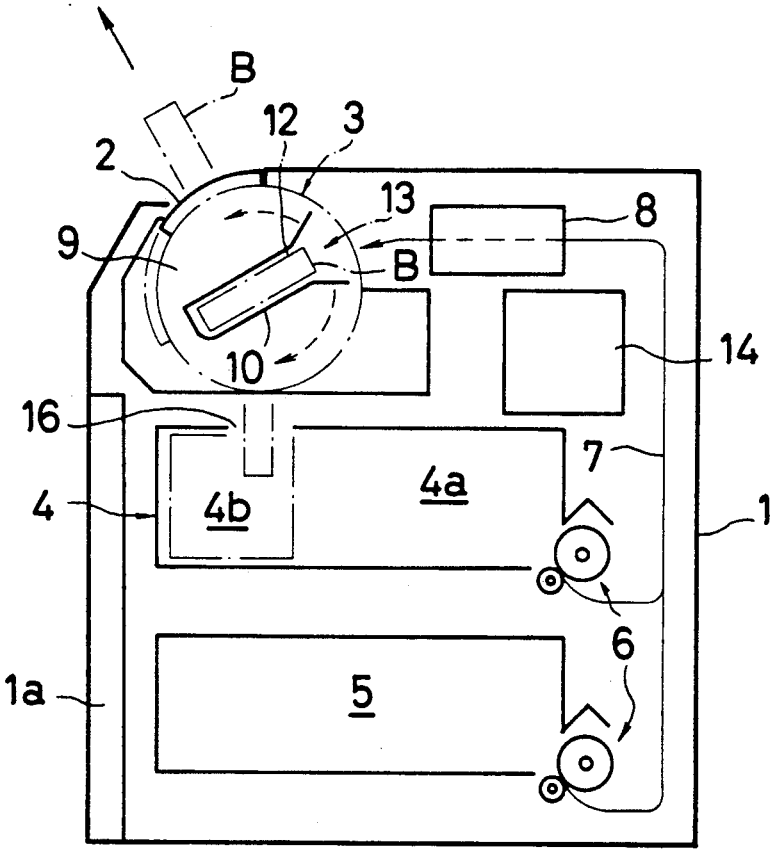
FIG. 1 is a schematic drawing showing the mechanism of a bill dispensing machine which is an embodiment of the present invention.

FIG. 1 is a schematic drawing showing a mechanism of a bill dispensing machine which is an embodiment of the present invention.

In FIG. 1, a drum 3 is provided in the vicinity of a bill dispening opening 2 of a bill dispensing machine 1, and a first bill dispensation box 4 is provided below the drum 3 and a second bill dispensation box 5 is provided below the first bill dispensation box 5, these first and second bill dispensation boxes 4, 5 being horizontally detachable from the bill dispensing machine. The first and second bill dispensation boxes 4, 5 contain bills B of different denominations for dispensing. Bills B to be dispensed are taken out one by one from the first and/or second bill dispensation boxes 4, 5 by bill take-out mechanism 6 comprising a plurality of rollers and fed to a bill dispensation passage in a well known manner, and after the bills B have been counted and double feed of bills B and their denominations have been discriminated by a discriminating means 8 provided on the bill dispensation passage 7, the bills B are fed to the drum 3.

Figure 2:
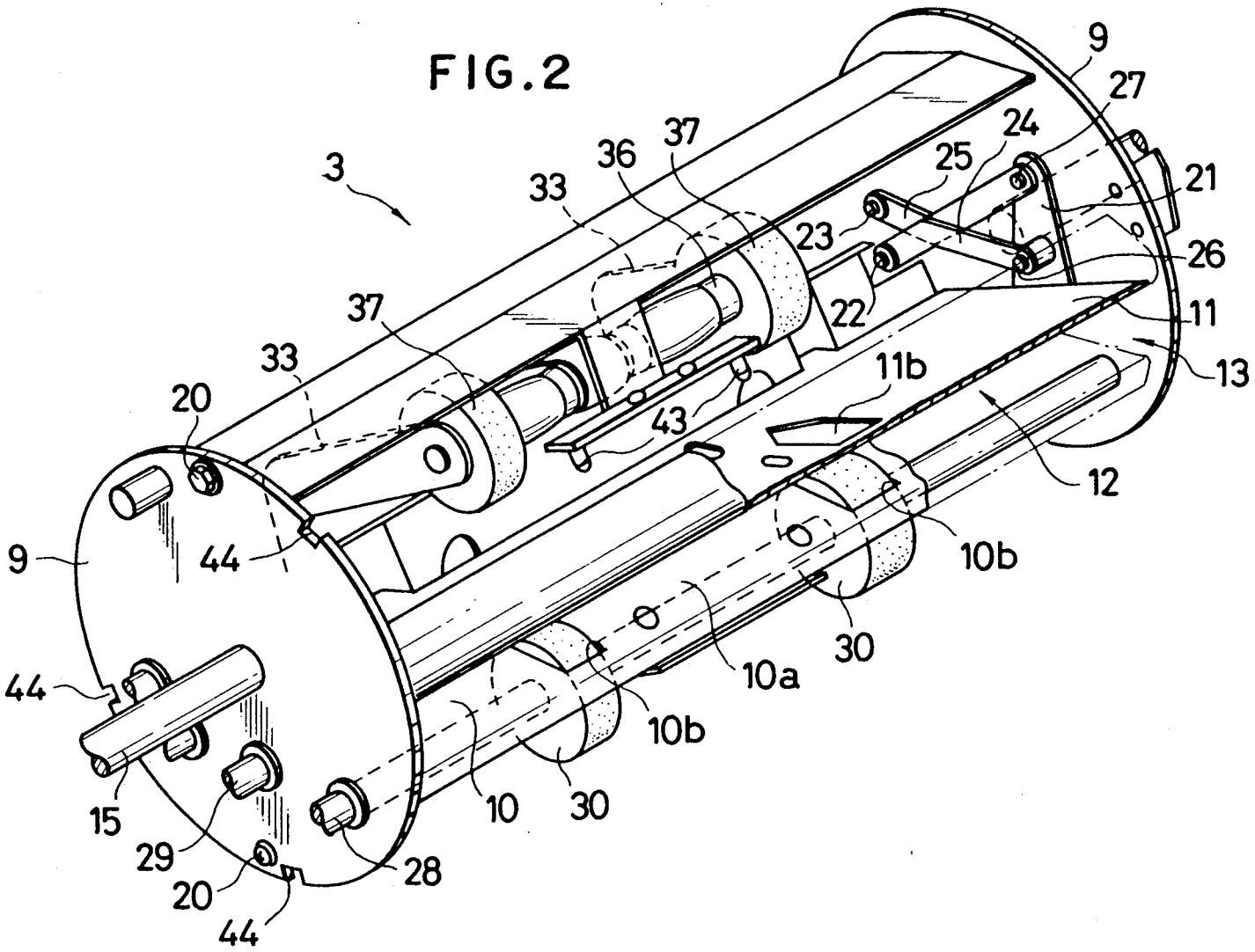
FIG. 2 is a schematic drawing showing a perspective view of a drum used in the bill dispensing machine shown in FIG. 1.

As shown in FIG. 2, the drum 3 has a bill accumulating portion 12 formed by a bottom plate 10 and a press plate 11, the bottom plate 10 and the press plate 11 being supported between a pair of disks 9, 9 and, as described in detail later, the bills B discriminated by the discriminating means 8 are received via an opening 13 of the bill accumulating portion 12 by the bill accumulating portion 12 and accumulated therein. The drum 3 is mounted on a center shaft 15 so as to be rotatable together with the center shaft 15 by a gear train (described in detail later) driven by a motor 14, the center shaft 15 being rotatably mounted on plate members (not shown in FIGS. 1 and 2), and the drum 3 can be positioned so that the bill accumulating portion 12 faces the bill dispensation opening 2, an outlet portion of the bill dispensation passage 7 or an opening 16 provided for the first bill dispensation box 4 in such a manner that the bills can be transferred from or to them. The drum 3 is always positioned so that the bill accumulating portion 12 faces the outlet portion of the bill dispensation passage 7 when no bill is present in the bill accumulating portion 12. As shown in FIG. 1, the first bill dispensation box 4 is divided into two sections and the section thereof on the side of the bill take-out means 6 forms a dispensation bill containing section 4*a* wherein bills to be dispensed are contained and the section thereof on the side of the opening 16 forms a bill collecting section 4*b* for receiving and collecting bills accumulated in the bill accumulating portion 12 together with bills transported from the first and/or second bill dispensation boxes 4, 5 and present in the bill discriminating means 8, when the bill discriminating means 8 detects double feed of bills or a bill having a different denomination from the predetermined one, for example, in the case where the denomination of a bill transported from the first bill dispensation box 4 accords with that contained in the second bill dispensation box 5. The motor 14 is the power source for rotating the drum 3 clockwise or counterclockwise, driving the bill takeout means 6 and transporting bills along the bill dispensation passage 7.

Figure 3:
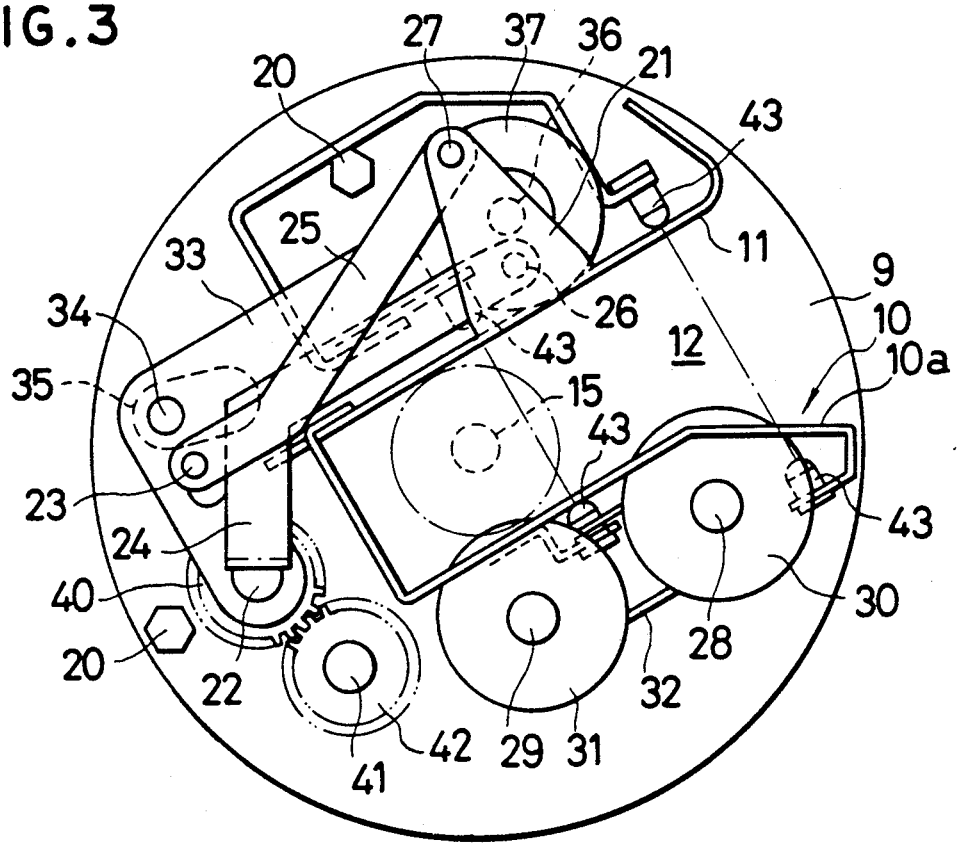
FIG. 3 is a schematic drawing showing a left side view of the drum shown in FIG. 2 with a left side disk removed.
Figure 4:
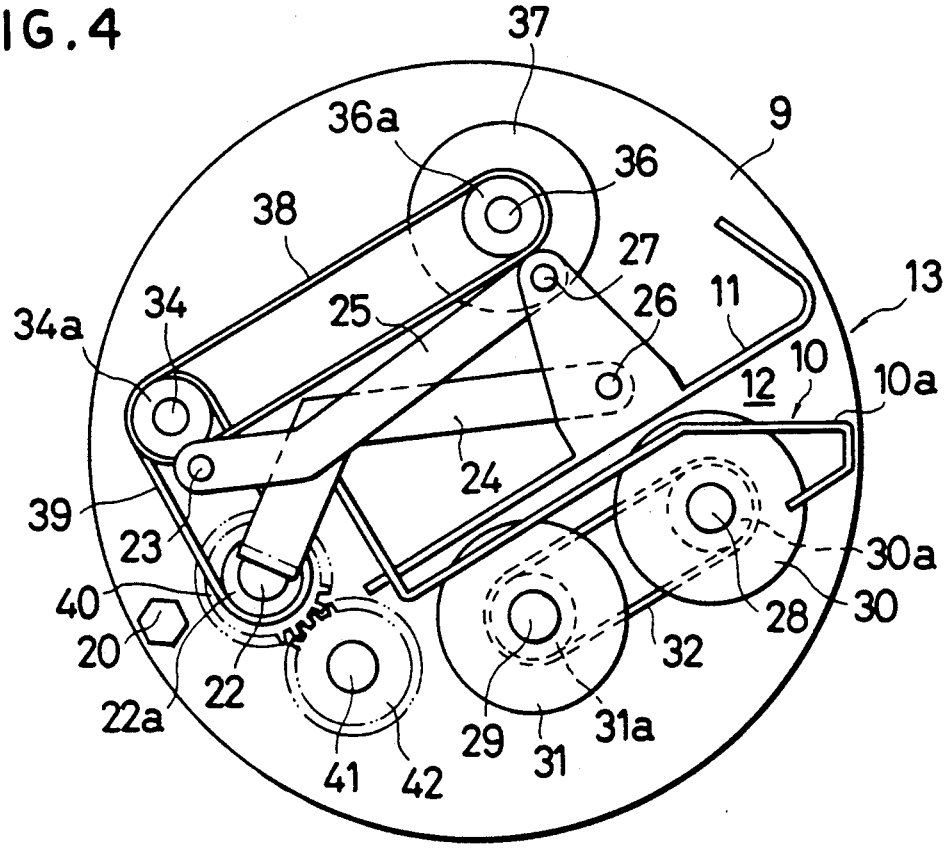
FIG. 4 is a schematic drawing showing a left side view of the drum shown in FIG. 2 with a left side disk removed and a press plate positioned close to a bottom plate.

FIGS. 3 and 4 show a left side view of the drum 3 in the condition where the bill accumulating portion 12 face the outlet portion of the bill dispensation passage 7. The left side disk is omitted in the drawing for the convenience of explanation.

Referring to FIGS. 2 to 4, the pair of disks 9, 9 are disposed in parallel as spaced apart by a distance slightly greater than the length of bills B and are connected by a plurality of stays 20. The bottom plate 10 of the bill accumulating portion 12 is secured to the disks 9, 9 and the press plate 11 has a pair of guide plates 21, 21 at the opposite ends in the longitudinal direction thereof. At each end, a first arm 24 and a second arm 25 swingably mounted on the disk 9 about the shafts 22, 23 respectively are mounted on the guide plate 21 by pins 26, 27 respectively in such a manner that the guide plate 21 is rotatable about the pins 26, 27. The press plate 11 is positioned by a cam mechanism to be described in detail later so as to be apart from the bottom plate 10 as shown in FIG. 3 when the opening 13 of the bill accumulating portion 12 faces the bill dispensation opening 2 for dispensing bills B from the bill accumulating portion 12 to the outside of the bill dispensing machine 1 via the bill dispensing opening 2 and to be able to close onto the bottom plate 10 and hold bills B between itself and the bottom plate 10 as shown in FIG. 4 when the opening 13 of the bill accumulating portion 12 faces the outlet portion of the bill dispensation passage 7 and can receive bills B from the bill dispensation passage 7 and when the opening 13 of the bill accumulating portion 12 faces the opening 16 of the bill collecting section 4*b* of the first bill dispensation box 4 and bills accumulated in the bill accumulating portion 12 will be collected by the bill collecting section 4*b* via the opening 16.

The upper face of the bottom plate 10 of the bill accumulating portion 12 is formed in the vicinity of the opening 13 with a sloped portion 10*a* inclined away from the press plate 11 in the vicinity of the opening 13 so as to facilitate the receipt of bills B via the opening 13. Although not shown in FIGS. 2 to 4, the center shaft 15 of the disks 9, 9 is rotatably supported by the plate members fixed to the bill dispensing machine 1.

Below the bottom plate 10 of the bill accumulating portion 12, transport roller shafts 28, 29 are rotatably mounted between the pair of disks 9, 9 in parallel to the center shaft 15 and pairs of rubber transport rollers 30, 31 are fixed on the transport roller shafts 28, 29, respectively. Each of the transport rollers 30, 31 projects upward above the upper face of the bottom plate 10 via one of four openings 10*b* formed in the bottom plate 10. Each of the transport rollers 30, 31 is integrally formed with a pulley 30*a*, 31*a* and the transport rollers 30, 31 are rotatable in the same direction by a belt 32 engaged with the pulleys 30*a*, 31*a*. In the case where the opening 13 of the bill accumulating portion 12 faces the outlet portion of the bill dispensation passage 7, the transport rollers 30, 31 are rotated at higher speed by a gear train described in detail later and the bills B are received by the bill accumulating portion 12 and accumulated therein promptly. On the other hand, in the case where the opening 13 of the bill accumulating portion 12 faces the opening 16 of the first bill dispensation box 4 for feeding the bills B accumulated in the bill accumulating portion 12 to the bill collecting section 4*b* of the first bill dispensation box 4, the transport rollers 30, 31 are rotated at lower speed by the gear train and the bills are fed to the bill collecting section 4*b* slowly. Further, in the case where the opening 13 of the bill accumulating portion 12 faces the bill dispensation opening 2 for dispensing the bills B accumulated in the bill accumulating portion 12 to customers via the bill dispensation opening 2, the transport rollers 30, 31 are not rotated.

A pair of L shaped levers 33, 33 are provided above the press plate 11 of the bill accumulating portion 12, each lever 33 being swingably mounted on the shaft 22, which is also the shaft about which the first arms 24 swing. A central shaft 34 is rotatably mounted on the levers 33 at a central portion thereof and projects from one of the disks 9 outward via a slot 35. A press roller shaft 36 is rotatably supported on the levers 33, 33 at the tip ends thereof and rubber press rollers 37, 37 are fixed to the press roller shaft 36 in the vicinity of the tip ends of the levers 33, 33 and each of the press rollers 37, 37 is projectable downward from the press plate 11 to the bill accumulating portion 12 via one of two openings 11*b*, 11*b* formed in the press plate 11. Further, the press roller shaft 36 is connected to the central shaft 34 by a belt 38 engaged with a pulley 36*a* integrally formed on the press roller shaft 36 and a pulley 34*a* integrally formed on the central shaft 34 and a belt 39 is engaged with the pulley 34*a* of the central shaft 34 and a pulley 22*a* rotatably mounted on the shaft 22 of the first arm 24, whereby the central shaft 34 and the pulley 22*a* are connected with each other. Moreover, a gear 40 is mounted on the shaft 22 of the first arm 24 so as to be rotatable with the pulley 22*a* and is engaged with a gear 42 rotatable together with a shaft 41 rotatably mounted on one of the disks 9.

In cases where the opening of the bill accumulating portion 12 faces the outlet portion of the bill dispensation passage 7 to receive bills B from the bill dispensation passage 7 and where the opening of the bill accumulating portion 12 faces the bill dispensation opening 2 to dispense bills B via the bill dispensation opening 2, as shown in FIG. 3, the press rollers 37, 37 are positioned apart from the bottom plate 10 by a cam mechanism described in detail later. On the other hand, in the case where the opening of the bill accumulating portion faces the opening 16 of the bill collecting section **4*b* of the first bill dispensation box 4 to collect the bills B accumulated in the bill accumulating portion 12 by the bill collecting section 4*b* via the opening 16, the press rollers 37, 37 are positioned close to the bottom plate 10 so as to project into the bill accumulating portion 12 via the openings 11*b*, 11*b*, whereby the bills B are held between the press rollers 37, 37 and the transport rollers 30, 31 projecting into the bill accumulating portion 12 via the openings 10*b* in the bottom plate 10 and fed slowly to the bill collecting section 4*b* by the cam mechanism described in detail later. In FIG. 4, the levers 33, 33** are omitted for the convenience of explanation.

As shown in FIGS. 2 and 3, although not in FIG. 4, photosensors 43 for sensing bills B in the bill accumulating portion 12 are provided for the bottom plate 10 and the press plate 11 in the vicinity of the opening 13 and the central portion of the bill accumulating portion 12.

As shown in FIG. 2, the left disk 9 is formed with three engaging members 44, 44, 44, each consisting of a notch and the drum can be selectively positioned by engaging one of the engaging members 44, 44, 44 with a pin member provided on the body of the bill processing machine as described in detail later in such a manner that the opening 13 of the bill accumulating portion 12 faces the bill dispensation opening 2, the bill dispensation passage 7 or the opening 16 of the first bill dispensation box 4 for transferring the bills between the bill accumulating portion 12 and the opening or passage concerned.

Figure 5:
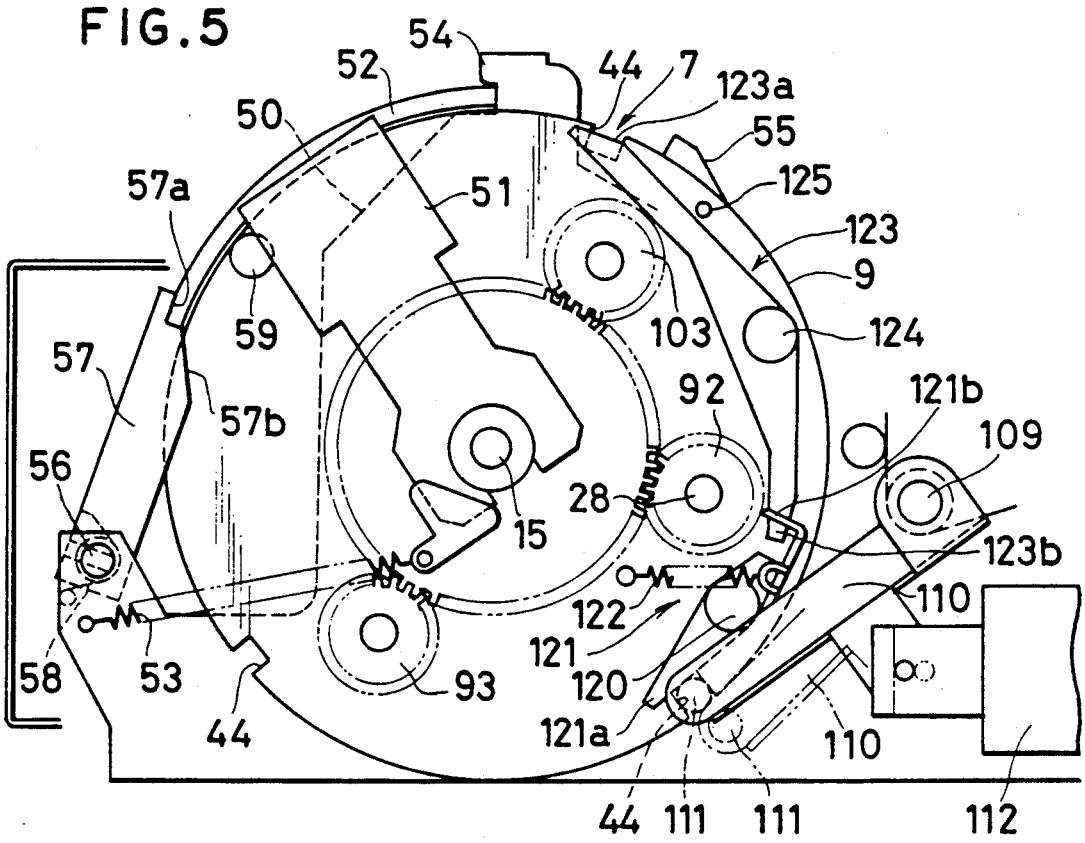
FIG. 5 is a schematic drawing showing a left side view of the drum, a drum position regulating mechanism and a shutter mechanism used in the bill dispensing machine shown in FIG. 1.
Figure 6:
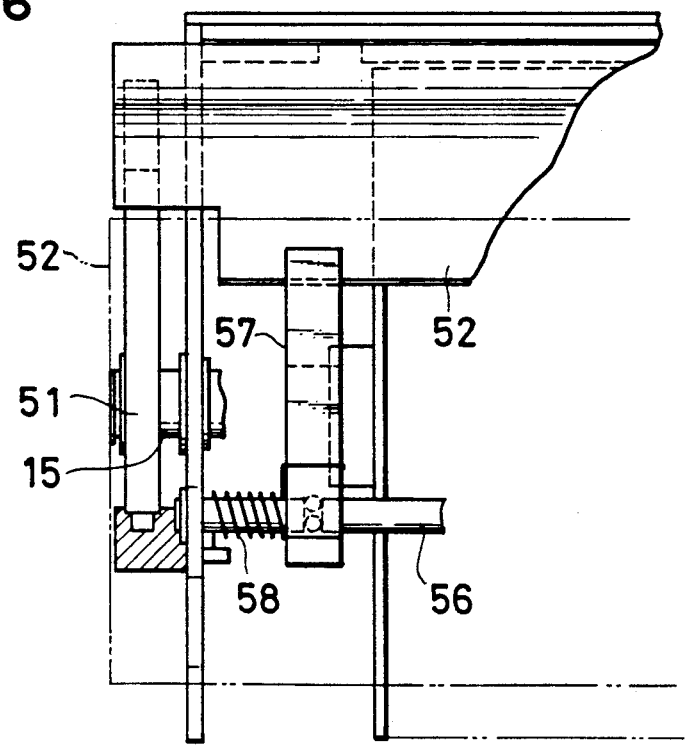
FIG. 6 is a schematic drawing showing a partial rear view of the shutter mechanism shown in FIG. 5.

FIG. 5 shows a left side view of drum position regulating mechanism for normally positioning the drum 3 in such a manner that the bill accumulating portion 12 faces the outlet portion of the bill dispensation passage 7 and a shutter mechanism for closing the bill dispensation opening 2, and FIG. 6 shows a partial rear view of the shutter mechanism.

Referring to FIGS. 5 and 6, the center shaft 15 of the drum 3 is rotatably mounted on a pair of plate members 50, 50 fixed to the body of the bill dispensing machine 1 at the outside of the pair of the disks 9, 9 and further extends outward. A pair of shutter arms 51 are swingably mounted on the center shaft 15 at the outside of the plate members 50, 50. Each of the shutter arms 51, 51 has a rotation radius slightly larger than that of the disk 9 and a shutter plate 52 shaped to conform to the outer shape of the disk 9 is secured to the pair of shutter arms 51 at the tip end thereof and covers the outside of the drum 3. In FIGS. 5 and 6, since the bill accumulating portion 12 of the drum 3 faces the bill dispensation passage 7, the shutter plate 52 is positioned so as to face the bill dispensation opening 2 and close it. In FIG. 5, the plate members 50, 50 are drawn in phantom lines for convenience of explanation.

One end of a tension spring 53 is fixed to each of the plate members 50, 50 and the other end thereof is secured to a portion of the shutter arms 51, 51 near the center shaft 15, thereby to bias the shutter arms clockwise in FIG. 5. The plate members 50, 50 fixed to the body of the bill dispensing machine 1 are connected with each other by a stay 54. The right edge of the shutter plate 52 abuts against the stay 54 in FIG. 5 so that the shutter plate 52 is prevented from rotating clockwise and is thus positioned there by at a predetermined location.

Further, as shown in FIG. 5, although not in FIGS. 2 to 4, a shutter press member 55 is formed on the circumference of each disk 9 so as to project outward. The shutter press members 55, 55 can abut against the shutter plate 52 and rotate it counterclockwise when the drum 3 is rotated counterclockwise by the gear train described later. Still further, a lock arm shaft 56 is rotatably mounted on the pair of plate members 50, 50 so as to connect them and a pair of shutter lock arms 57, 57 are swingably mounted on the lock arm shaft 56. Springs 58, 58 are secured to the shutter lock arms 57, 57 at the portion where they are mounted on the lock arm shaft 56 and the plate members 50, 50 to bias the shutter lock arms 57, 57 clockwise in FIG. 5. Each of the shutter lock arms 57, 57 is formed with a notch **57*a* at the tip end thereof. The shutter plate 52 is prevented from rotating counterclockwise when its left edge engages the notches 57*a*, 57*a*. Moreover, release pins 59, 59 are provided on the outer face of the pair of disks 9, 9 in the vicinity of the outer edge thereof so as to project outward. In the case where the drum 3 is rotated counterclockwise by the gear train, the release pins 59, 59 abut against sloped portions 57*b*, 57*b* formed on the shutter lock arms 57, 57 and push the shutter lock arms 57, 57 away to swing them counterclockwise about the lock arm shaft 56, thereby to release the engagement between the left edge of the shutter plate 52 and the notches 57*a*, 57*a* of the shutter lock arms 57, 57 and enable the shutter plate 52** to rotate counterclockwise.

As explained above, the drum 3 is normally positioned such that the bill accumulating portion 12 faces the outlet portion of the bill dispensation passage 7 by restricting the rotation of the shutter arms 51, 51 and the shutter plate 52 by the stay 54 and the shutter lock arms 57, 57.

Figure 7:
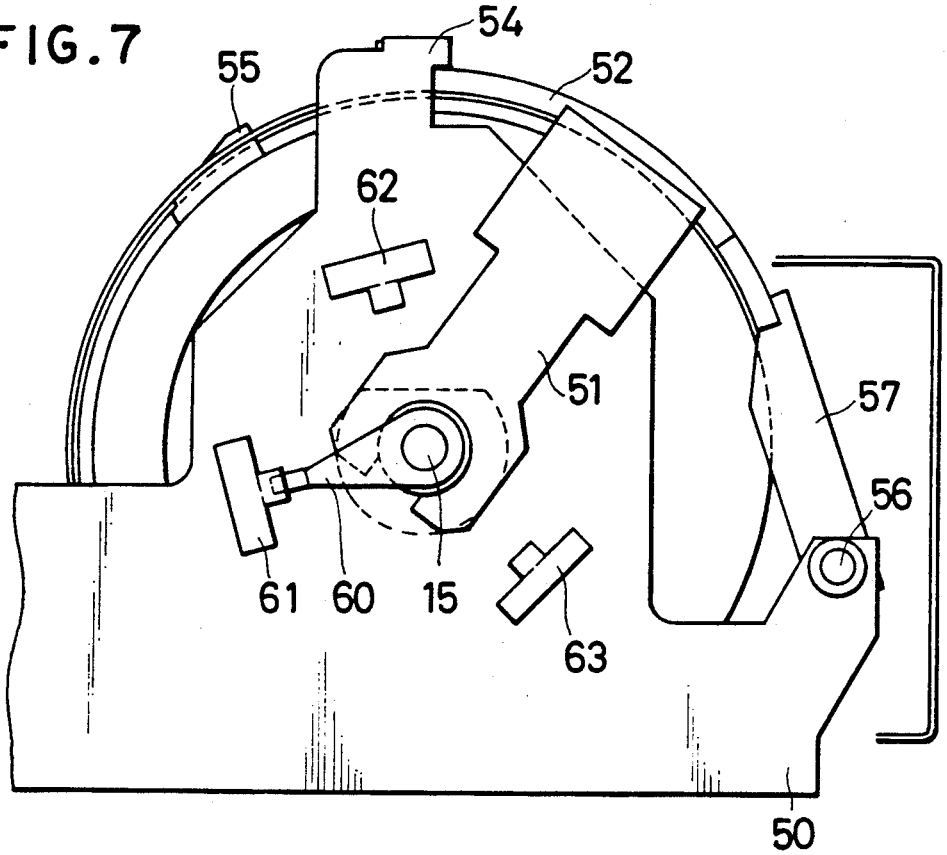
FIG. 7 is a schematic drawing showing a right side view of the drum shown in FIG. 2 and a drum position detection mechanism.

FIG. 7 shows a right side view of the drum 3 and a drum position detecting mechanism.

Referring to FIG. 7, an actuating plate 60 is fixed to the center shaft 15 extending from one of the plate members 50, 50 and three photo interruptors 61, 62 and 63, each having a light emitter and light receiver pair (not shown) are secured to the outer face of the one of the plate members 50, 50. These photo interruptors 61, 62 and 63 constitute a drum position detecting mechanism. More specifically, the photo interruptors 61, 62 and 63 are positioned in such a manner that when the bill accumulating portion 12 of the drum 3 faces the bill dispensation passage 7, the actuating plate 60 is positioned at the photo interruptor 61 and prevents the light receiver from receiving light emitted from the light emitter in the photo interruptor 61, when the bill accumulating portion 12 of the drum 3 faces the bill dispensation opening 2, the actuating plate 60 is positioned at the photo interruptor 62 and prevents the light receiver from receiving light emitted from the light emitter in the photo interruptor 62, and when the bill accumulating portion 12 of the drum 3 faces the bill collecting section **4*b* of the first bill dispensation box 4, the actuating plate 60 is positioned at the photo interruptor 63 and prevents the light receiver from receiving light emitted from the light emitter in the photo interruptor 63, whereby the position of the drum 3** can be detected.

Figure 8:
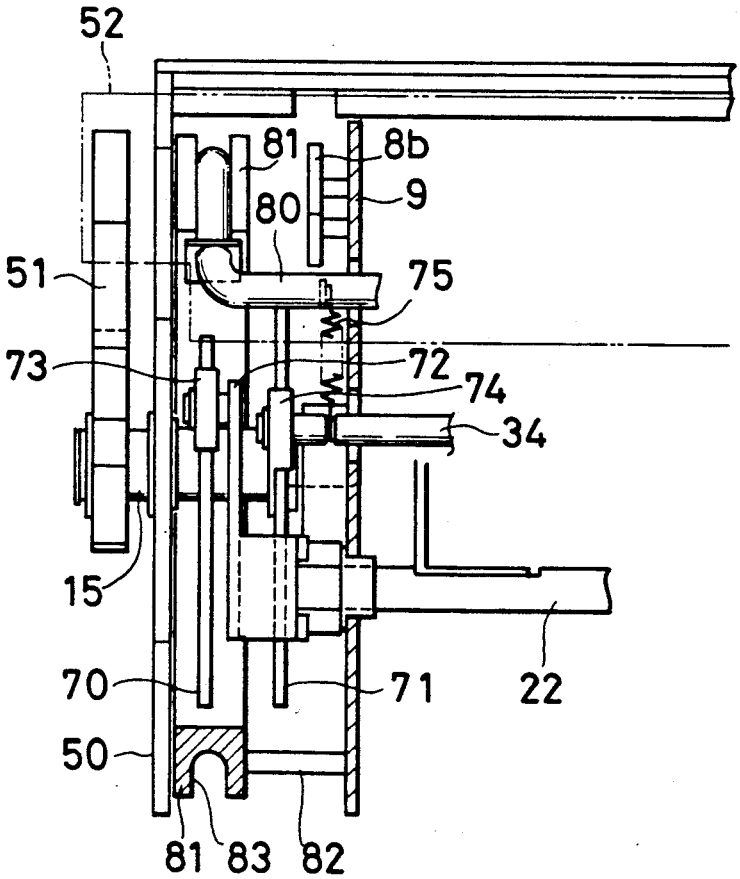
FIG. 8 is a schematic drawing showing a partial rear view of the drum shown in FIG. 2, a plate member and a cam mechanism.
Figure 9:
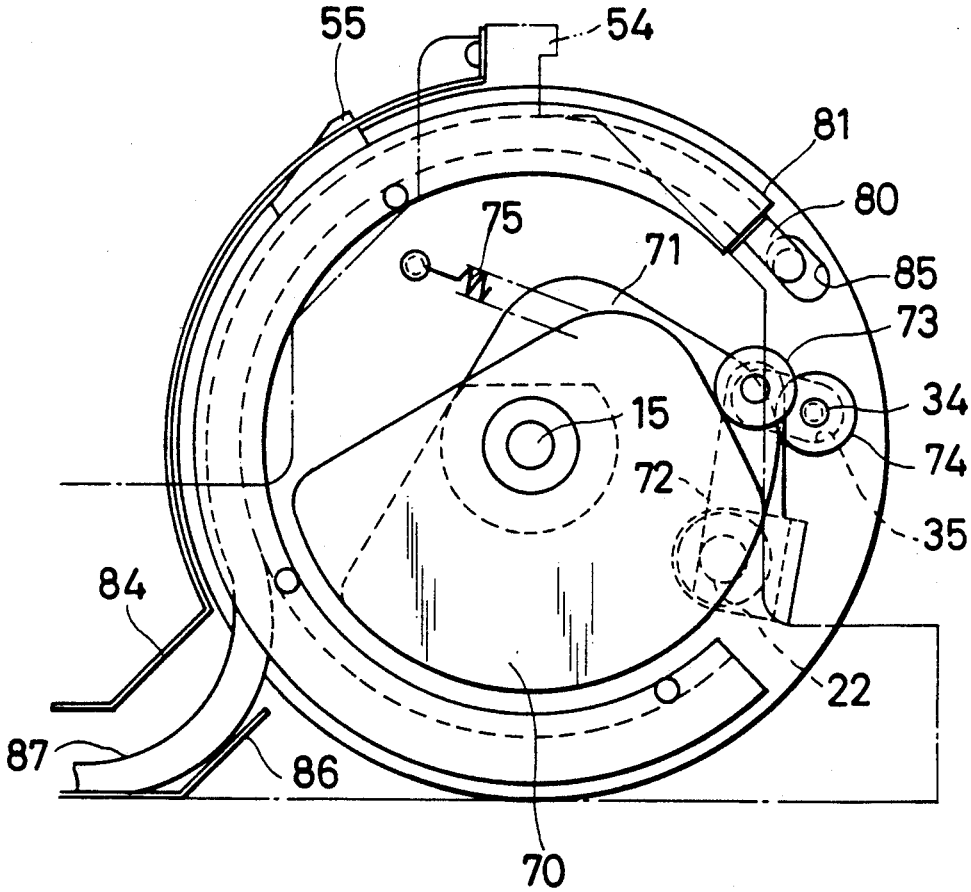
FIG. 9 is a schematic drawing showing a right side view of the drum shown in FIG. 2 and the plate member shown in FIG. 8.

FIG. 8 shows a partial rear view of the drum 3 and the plate members 50, 50, and FIG. 9 shows a right side view of FIG. 8, wherein there is shown in detail the cam mechanism provided on the outside of the right disk 9 for moving the press plate 11 and the press rollers 37, 37.

Referring to FIGS. 8 and 9, plate-like cams 70, 71 are provided between the right disk 9 and the right plate member 50 and are fixed to the right plate member 50 so as to be rotatable with respect to the center shaft 15. A cam follower 73 is rotatably supported by a lever 72 swingably mounted on one end of the shaft 22 of the first arm 24 and a cam follower 74 is rotatably mounted on the central shaft 34 of the L shaped levers 33, 33. The press plate 11 and the press rollers 37, 37 can be moved by respectively moving the cam followers 73 and 74 along lobes of the plate-like cams 70, 71. More specifically, the cam follower 73 is in constant rotatable abutment against the lobe of the plate-like cam 70 by moment about the shaft 22 produced by the force of gravity acting on the press plate 11, whereby the press plate 11 is always movable and is moved so as to be apart from the bottom plate 10 or close against the bottom plate 10 in accordance with the rotation of the drum 3. On the other hand, the cam follower 74 rotatably mounted on the central shaft 34 of the L shaped levers 33, 33 is biased by a tension spring 75, one end of which is secured to the outer face of the right disk 9, so as to rotatably abut against the plate-like cam 71, thereby to move the press rollers 37, 37 in accordance with change in the position of the central shaft 34 generated by the rotation of the drum 3. In FIG. 9, the bill accumulating portion 12 faces the outlet portion of the bill dispensation passage 7 and, therefore, the press rollers 37, 37 are positioned apart from the bottom plate 10. In the case where the drum 3 is rotated so that the bill accumulating portion 12 faces the bill dispensation opening 2, the cam followers 73, 74 rotate and move clockwise along the lobes of the plate-like cams 70, 71 respectively and hold the press plate 11 and the press rollers 37, 37 at the positions apart from the bottom plate 10. On the other hand, in the case where the drum 3 is rotated so that the bill accumulating portion 12 faces the bill collecting section **4*b* of the first bill dispensation box 4, the cam followers 73, 74 rotate and move counterclockwise along the lobes of the plate-like cams 70, 71 respectively and move the press plate 11 and the press rollers 37, 37 to the positions close to the bottom plate 10**.

Figure 10:
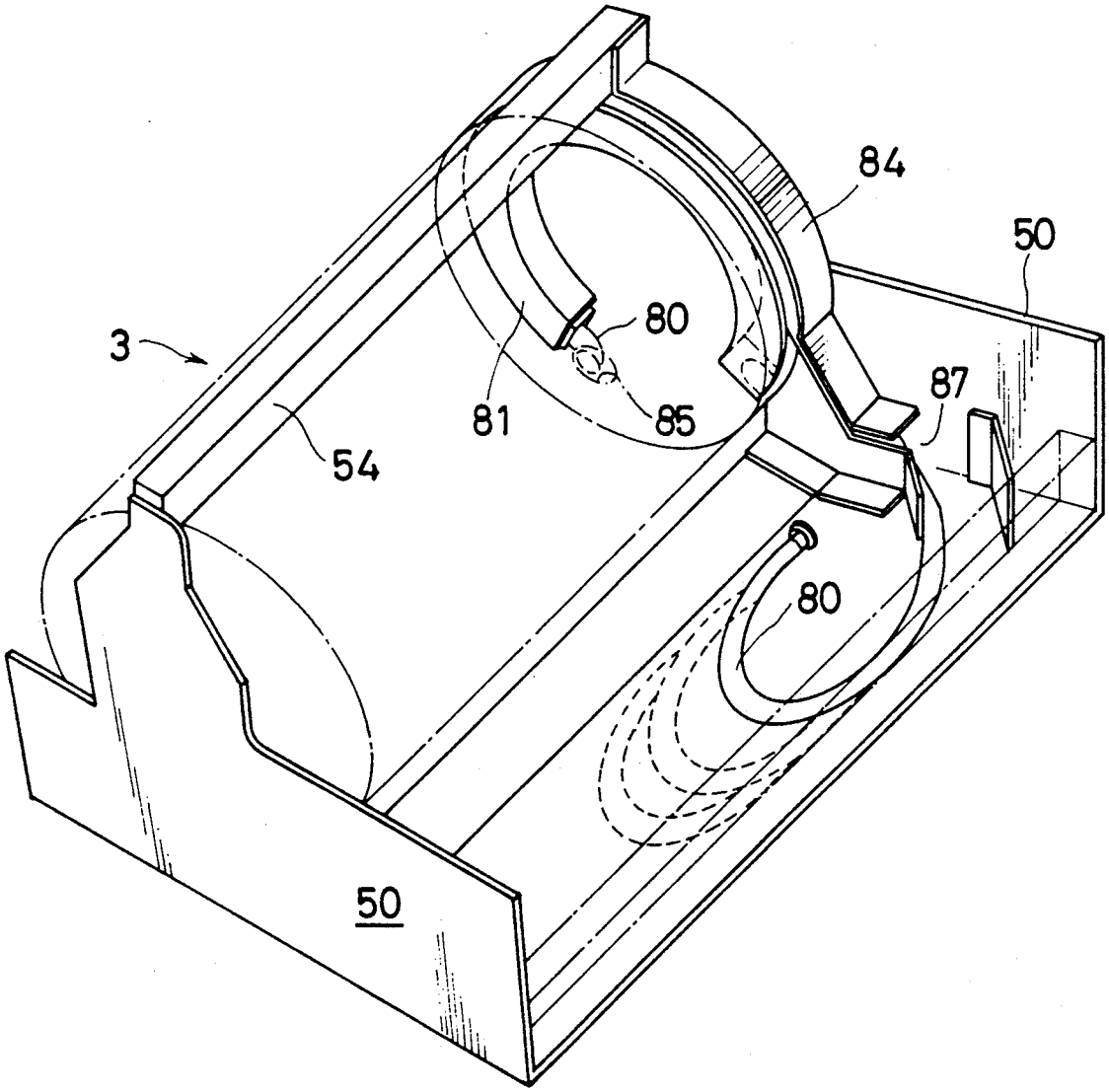
FIG. 10 is a schematic drawing showing a perspective view of electric wiring of the drum shown in FIG. 1.

Referring to FIGS. 8 and 9 and FIG. 10 showing a perspective view of electric wiring of the drum 3, there is provided on the drum 3 an arc-shape coil spring guide member 81 which is rotatable together with the right disk 9 for guiding a coil spring 80 covering a cable (not shown) for electrical connection between the photosensors 43 and the outside of the drum 3. The coil spring guide member 81 is fixed to the right disk 9 by a plurality of connecting members 82 in such a manner that the outer circumference thereof is positioned slightly inside of that of the disk 9. As shown in FIG. 8, the outer circumference of the coil spring guide member 81 is formed with a groove 83 and the coil spring 80 is received in and guided by the groove 83.

As shown in FIGS. 9 and 10, there is provided a cover plate 84 fixed to the stay 54 at one end thereof for covering the groove 83 of the coil spring guide member 81 and the right disk 9 is formed with a hole 85 in the vicinity of a one end of the coil spring guide member 81. The coil spring 80 guided by the coil spring guide member 81 is led into the drum 3 and the cable covered by the coil spring 80 is electrically connected to the photosensors 43 provided for the bill accumulating portion 12 of the drum 3. At the other end of the coil spring guide member 81, a guide plate 86 is provided as spaced from the cover plate 84 and a guide passage 87 is formed by the cover plate 84 and the guide plate 86 for guiding the coil spring 80 to deliver it to the groove 83 of the coil spring guide member 81.

Accordingly, when the drum 3 is rotated, since the coil spring guide member 81 rotates with the drum 3, the coil spring 80 is drawn out from the guide passage 87 by the coil spring guide member 81 or is fed into the guide passage 87 from the coil spring guide member 81.

Figure 11:
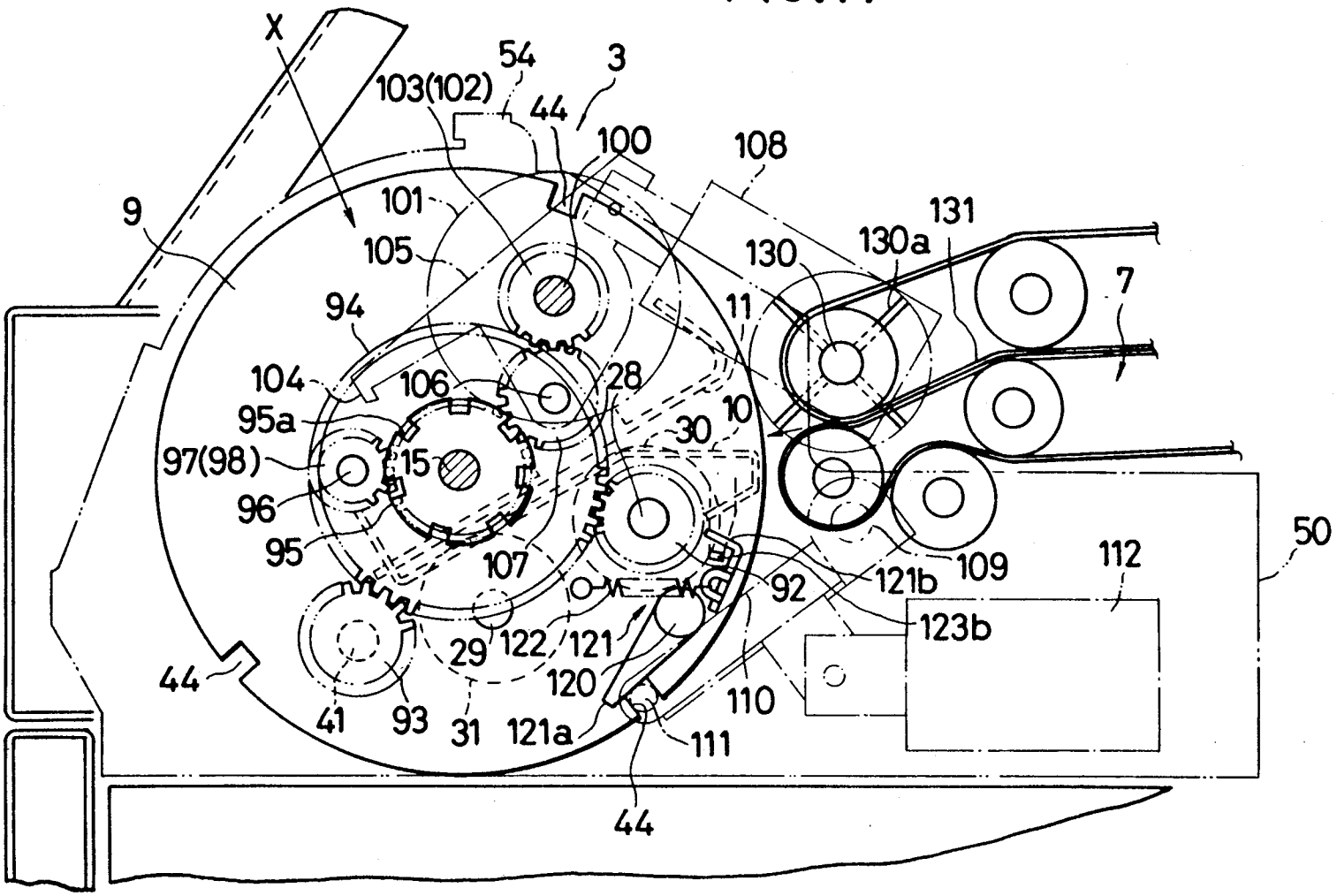
FIG. 11 is a schematic drawing showing a left side view of the drum shown in FIG. 2 and an outlet portion of a bill dispensation passage.
Figure 12:
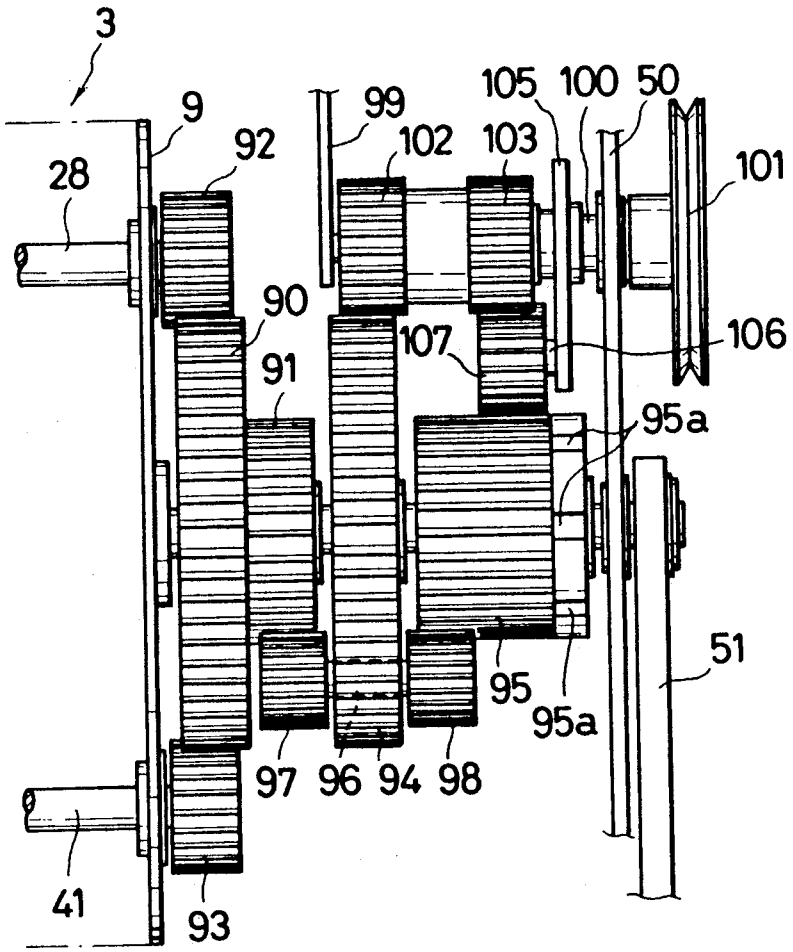
FIG. 12 is a schematic drawing showing a partial side view taken in the direction of an arrow X shown in FIG. 11, in the condition where a lock lever and a notch of a wide gear are not engaged with each other.

FIG. 11 shows a left side view of the drum 3 and the outlet portion of the bill dispensation passage 7 wherein the bill accumulating portion 12 faces the outlet portion of the bill dispensation passage 7 and FIG. 12 shows a partial side view thereof taken in the direction of an arrow X shown in FIG. 11.

Referring to FIGS. 11 and 12, between the left disk 9 and the left plate member 50, a large-diameter sun gear 90 and a small-diameter sun gear 91 are rotatably mounted on the center shaft 15, these sun gears 90 and 91 being integrally formed. The transport roller shaft 28 rotatable with the transport rollers 30, and the shaft 41 rotatable with the gear 42 engaged with the gear 40 rotatable in synchronism with the rotation of the press rollers 37, 37 are provided so as to be spaced from the center shaft 15 by the same distance and to project from the left disk 9 toward the left plate member 50. A pair of planetary gears 92 and 93 are respectively mounted on the transport roller shaft 28 and the shaft 41 so as to be rotatable with them. The planetary gears 92, 93 engage with the large-diameter sun gear 90. Further, a gear 94 is rotatably mounted on the center shaft 15 on the plate member 50 side of the sun gears 90, 91, and a wide gear 95 of large width is rotatably mounted on the center shaft 15 on the plate member 50 side of the gear 94. In the vicinity of the circumferential portion of the gear 94, there are provided a planetary gear 97 rotatable about a shaft 96 parallel with the center shaft 15 and engaged with the sun gear 91, and a planetary gear 98 rotatable about the shaft 96 and engaged with the wide gear 95.

Furthermore, as shown in FIG. 12, a side plate 99 is fixed to the left plate member 50 at a position between the left disk 9 and the left plate member 50, and an input shaft 100 is rotatably mounted on the plate member 50 and the side plate 99. Driving force of the motor 14 can be transmitted to the input shaft 100 via a pulley 101 secured to an end of the input shaft 100. A small-diameter gear 102 engaged with the large-diameter gear 94 and a small-diameter gear 103 are fixed to the input shaft 100 to be rotatable therewith. The gear 103 is engageable with an intermediate gear 107 rotatably supported by a shaft 106 secured to a lock arm 105 which has a lock lever 104 at the tip end thereof and is swingably mounted on the input shaft 100.

Figure 13:
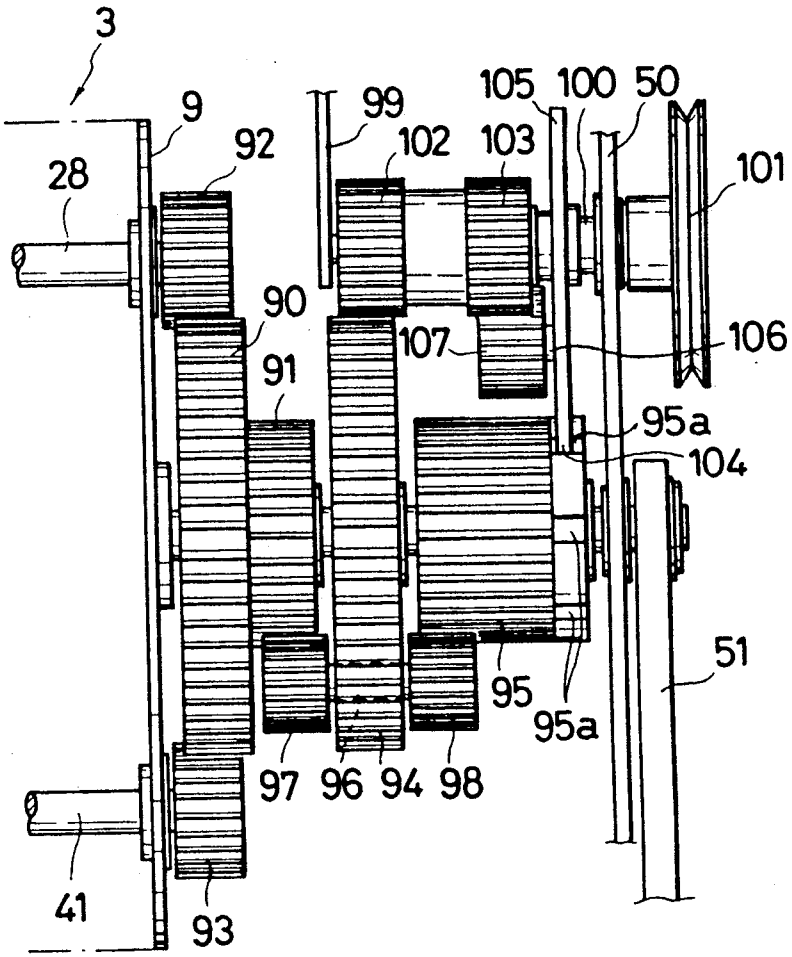
FIG. 13 is a schematic drawing showing a partial side view taken in the direction of an arrow X shown in FIG. 11 in the condition where a lock lever and a notch of a wide gear are engaged with each other.

As shown in FIG. 11, one side face of the wide gear 95 in the vicinity of the circumferential portion thereof is formed with a plurality of notches **95*a* spaced from each other by a predetermined distance along the circumference of the wide gear 95 and one of the notches 95*a* can be engaged with the lock lever 104 of the lock arm 105 swingably mounted on the input shaft 100. The lock arm 105 can be swung about the input shaft 100 by a solenoid 108. In the case where the lock arm 105 is swung clockwise in FIG. 11, the engagement between the lock lever 104 and the notch 95***a* is released, and the intermediate gear 107 rotatably mounted on the shaft 106 of the lock arm 105 is moved to a position between the wide gear 95 and the small-diameter gear 103 and engages with them. FIG. 12 shows this positional relation ship. On the other hand, in the case where the lock arm 105 is swung counterclockwise in FIG. 11, the lock lever 104 and the notch 95*a* are engaged with each other, and the intermediate gear 107 retracts from the position between the wide gear 95 and the small-diameter gear 103, thereby to release the engagement between these gears. FIG. 13 shows this positional relationship. From the above description, it will be understood that the rotation speed of the transport rollers 30, 31 can be switched between a higher speed and a lower speed by releasing the engagement between the lock lever 104 and the notch 95*a* and engaging the intermediate gear 107 with the wide gear 95 and the small-diameter gear 103, or engaging the lock lever 104 with the notch 95*a* and releasing the engagement between the intermediate gear 107, and the wide gear 95 and the small-diameter gear 103, in accordance with the swing of the lock arm 105 about the input shaft 100. In this embodiment, a plurality of notches 95*a* are formed for enabling the lock lever 104 to engage with the one of the notches 95*a* without fail independently of the position of the wide gear 95.

Further, a pin 109 is secured to the plate member 50 in the vicinity of the left disk 9 and the bill dispensation passage 7, and a lock arm 110 is swingably mounted on the pin 109. A tip end of the lock arm 110 is formed with a lock pin 111 and a solenoid 112 is connected to the central portion of the lock arm 110. When the solenoid 112 is turned off, the lock arm 110 is swung clockwise about the pin 109 and the lock pin 111 engages with one of the engaging members 44 formed on the circumference of the left disk 9, whereby the drum 3 is positioned at a predetermined location. On the other hand, in the case where the solenoid 112 is turned on, the lock arm 110 is swung counterclockwise about the pin 109 and the lock pin 111 is disengaged from the engaging member 44 of the disk 9.

Furthermore, as shown in FIGS. 5 and 11, a shaft 120 is secured to the outer face of the disk 9 in the vicinity of one of the engaging members 44 for engagement with the lock pin 111 in the case where the bill accumulating portion 12 is positioned to face the bill dispensation passage 7, and a lock member 121 is swingably mounted on the shaft 120. One end of the lock member 121 is formed with a press member 121*a* to be pressed by the lock pin 111 of the lock arm 110 in the case where the solenoid is turned off and the lock pin 111 of the lock arm 110 engages with the engaging member 44, and the other end of the lock member 121 is formed with a engaging member 121*b* engageable with the planetary gear 92 secured to the transport roller shaft 28 and rotatable therewith. A tension spring 122 fixed to the disk 9 at one end thereof is secured to the lock member 121 and the lock member 121 is biased counterclockwise by the tension spring 122. Accordingly, in the case where the solenoid is turned on and the engagement between the lock pin 111 of the lock arm 110 and the engaging member 44 of the disk 9 is released, since the engaging member 121*b* engages with the planetary gear 92, the transport roller 30, 31 are not rotated and only the disks 9, 9 rotate, and on the other hand, in the case where the solenoid 112 is turned off and the lock pin 111 of the lock arm 110 engages with the engaging member 44 of the disk 9, the press member 121*a* is pressed and pushed away by the lock pin 111 of the lock ar 110, whereby the the engagement between the engaging member 121*b* of the lock member 121 and the planetary gear 92 is released and the transport rollers 30, 31 are rotated.

Moreover, as shown in FIG. 5, a shaft 124 is secured to the outer face of the disk 9 between the engaging member 44 of the disk engaged with the lock pin 111 when the bill accumulating portion 12 is positioned to face the bill dispensation passage 7 and the engaging member 44 of the disk 9 engaged with the lock pin 111 when the bill accumulating portion 12 is positioned to face the bill collecting section 4*b* of the first bill dispensation box 4, and an operation lever 123 is swingably mounted on the shaft 124. One end of the operation lever 123 is formed with a press member 123*a* which is positioned in the vicinity of the engaging member 44 of the disk 9 to be engaged with the lock pin 111 of the lock arm 110 and is pressed by the lock pin 111 of the lock arm 110 when the bill accumulating portion 12 is positioned to face the bill collecting section 4*b* of the first bill dispensation box 4. The other end of the operation lever 123 is formed with a pawl 123*b* in the vicinity of the engaging member 44 of the disk 9 to be engaged with the lock pin 111 of the lock arm 110 when the bill accumulating portion 12 is positioned to face the bill dispensation passage 7. The pawl 123*b* is positioned so as to project in the vicinity of the engaging member 121*b* of the lock member 121, on the side of the center shaft 15. Therefore, when the bill accumulating portion 12 faces the bill collecting section 4*b* of the first bill dispensation box 4, the solenoid 112 is turned off and the lock pin 111 of the lock arm 110 engages with the engaging member 44 of the disk 9, the press member 123*a* is pushed away by the lock pin 111 of the lock arm 110 and the operation lever 123 is swung counterclockwise about the shaft 124. As a result, the engaging member 121*b* of the lock member 121 is moved in such a manner that the lock member 121 is swung clockwise about the shaft 120 and the engagement between the engaging member 121*b* of the lock member 121 and the planetary gear 92 is released, whereby the transport rollers 30, 31 become rotatable. The reference numeral 125 designates a pin provided on the outer face of the disk 9 so as to project for regulating the swing of the operation lever 123 in a predetermined manner.

Referring to FIG. 11, a vaned wheel 130 is provided between a plurality of pairs of transport belts 131 above the outlet portion of the bill dispensation passage 7 and the drum 3. Its vanes 130*a* are made of a flexible and elastic material such as rubber or plastic. The vaned wheel 130 is rotated clockwise in FIG. 11 and one of the vane 130*a* abuts with bending on the upper face of the bill B being held and transported between the transport belts, thereby to lift the rear edge of the bill B when the bill B is fed into the bill accumulating portion 12 of the drum 3. Accordingly, since the following bill B is necessarily fed by the next vane 130*a* of the vaned wheel 130 such that the front edge thereof is beneath the rear edge of the preceding bill B, the following bill B is fed one by one to the lower side of the preceding bill B and the bills B are accumulated in the bill accumulating portion 12.

The rotation speed of the vaned wheel 130 is determined such that the rotation speed of the tip end of the vanes 130*a* is not lower than the transporting speed of the bills B by the transport belts 131 even when a vane 130*a* is bent and its rotational radius becomes smaller, thereby to prevent the vaned wheel 130 from becoming a resistance to the transport of bills B. The bills B fed into the bill accumulating portion 12 are received and accumulated in the bill accumulating portion 12 promptly by the transport rollers 30, 31 rotating at higher speed.

Figure 14:
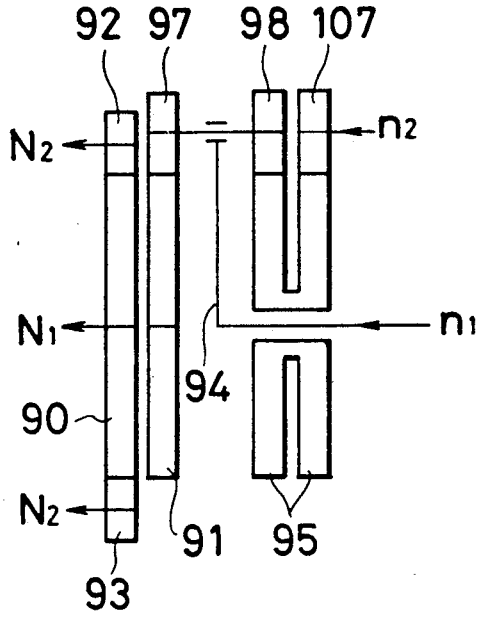
FIG. 14 is a schematic drawing showing the engagement relationship of a gear train.

FIG. 14 is a schematic drawing showing the engagement relationship of the gear train shown in FIGS. 12 and 13.

Referring to FIG. 14, supposing that the number of teeth of a gear i is designated $G_i$ and the input shaft 100 rotates by $n_0$, then the rotation at $n_1$ rpm of the large diameter gear 94 will be:

$$n_1 = -n_0 \times G_{102}/G_{94}$$

Therefore, the gear 94 functions as a swing arm swinging at $n_1$ rpm and supporting the gears 97 and 98.

On the other hand, the intermediate gear 107 rotates at $n_2$ rpm, where $G_{102} = G_{103}$.

$$n_2 = -n_0 \times G_{103}/G_{107}$$

Further, the rotation speed $N_1$ of the sun gear 91 and the sun gear 90 rotating together therewith is given by the following formula wherein the teeth numbers of the gears are determined such that $N_1$ has different sign from that of $n_1$ and $n_2$.

$$N_1 = n_1(1 - G_{97}\, G_{95}/G_{91}\, G_{98}) - n_2\, G_{107}\, G_{95}\, G_{97}/G_{95}\, G_{98}\, G_{91} \quad (1)$$

Therefore, in the case where the lock arm 105 is swung counterclockwise in FIG. 11, whereby the lock lever 104 engages with the notch 95*a* of the wide gear 95 and the intermediate gear 107 retracts from the position between the gear 103 and the wide gear 95 to release the engagement therebetween, $n_2$ becomes zero and $N_1$ is determined by $n_1$.

On the other hand, in the case where the lock arm 105 is swung clockwise, whereby the engagement between the lock lever 104 and the notch 95*a* of the wide gear 95 and the intermediate gear 107 is moved to the portion between the gear 103 and the wide gear to engage with them, $n_2$ is not zero and, therefore, the absolute value of $N_1$ at which the sun gears 90, 91 rotate increases.

More specifically, under the condition where the intermediate gear 107 engages with the wide gear 95, since the rotation $n_2$ is input, the absolute value of $N_1$ increases and the sun gears 90, 91 rotate at higher speed in the opposite direction to the gears 94 and 107.

In the case where the bill accumulating portion 12 is positioned to face the outlet portion of the bill dispensation passage 7, the lock pin 111 of the lock arm 110 is engaged with the engaging member 44 of the disk 9 and the disk 9, that is, the drum 3 is locked and cannot be rotated. Under these condition, since the press member 121*a* of the lock member 121 is pressed by the lock pin 111 and the engagement between the engaging member 121*b* of the lock member 121 and the planetary gear 92 is released, the rotation of the sun gear 90 is converted to the rotation of the planetary gears 92 and 93, whereby the planetary gears 92 and 93 rotates at $N_2$ rpm and $N_3$ rpm, respectively.

$$N_2 = N_1 \times G_{90}/G_{92} \quad (2)$$

$$N_3 = N_1 \times G_{90}/G_{93} \quad (3)$$

Since the teeth numbers of the sun gears 90 and 91 are greater than those of the planetary gears 92 and 93, $N_2$ and $N_3$ are always greater than $N_1$.

Accordingly, the transport roller shaft 28 is rotated at $N_2$ rpm and rotates the transport roller 30 mounted thereon and since the pulleys 30*a* and 31*a* integrally formed on the transport rollers 30 and 31 are connected by the belt 32, the transport roller 31 is also rotated. Since the diameters of the transport rollers 30, 31 are made the same, the transport rollers 30 and 31 rotate at the same speed. Further, the shaft 41 is rotated at $N_3$ rpm and rotates the press rollers 37, 37 via the gear 42, the gear 40, the pulley 22*a*, the belt 39, the pulley 34*a*, the belt 38 and the pulley 36*a*. In this embodiment, the teeth numbers of the planetary gears 92 and 93, the diameters of the pulleys 30*a* and 30*b*, the teeth numbers of the gears 42 and 40, and the diameters of the pulleys 22*a*, 34*a* and 36*a* are determined such that the circumferential speed of the press rollers 37, 37 are the same as that of the transport rollers 30 and 31. Under these condition, $n_2$ is not zero and the absolute value of the rpm $N_1$ becomes greater, whereby the transport rollers 30, 31 and the press rollers 37, 37 are rotated at the same higher speed. However, since the press rollers 37, 37 are positioned as spaced apart from the bottom plate 10, the bills B fed into the bill accumulating portion 12 from the bill dispensation passage 7 are taken into and accumulated in the bill accumulating portion 12 by only the transport rollers 30 and 31 at the higher speed.

On the other hand, when the lock pin 111 of the lock arm 110 is not engaged with the engaging member 44 of the disk 9 and the pair of disks 9, 9 are rotatable for changing the position of the opening 13 of the bill accumulating portion 12 of the drum 3, since the engaging member 121*b* of the lock member 121 is engaged with the planetary gear 92, the transport roller shaft 28 and the shaft 41 are prevented from rotating and the center shaft 15 of the disks 9, 9 is rotated at $N_1$ rpm, whereby the disks 9, 9 of the drum 3 are rotated at the lower speed and their positions are changed.

Further, when the bill accumulating portion 12 is positioned to face the opening 16 of the first bill dispensation box 4, the lock pin 111 of the lock arm 110 engages with the engaging member 44 of the disk 9 to prevent the drum from rotating and the pawl 123*b* releases the engagement between the engaging member 121*b* of the lock member 121 and the planetary gear 92 by pressing the press member 123*a* of the operation lever 123 by the lock pin 111, the transport roller shaft 28 is rotated at $N_2$ rpm and the shaft 41 is rotated at $N_3$ rpm. However, under these condition, since $n_2$ equals zero and the absolute value $N_1$ becomes smaller, the values $N_2$ and $N_3$ become smaller, whereby the transport rollers 30, 31 and the press rollers 37, 37 are rotated at lower speed than in the case where the bills B are taken into the bill accumulating portion 12.

As one example, if the teeth numbers of the gears are determined as follows and $n_0$ rpm of the input shaft 100 is determined as 495 rpm, $$G_{90} = 58,$$

$$G_{91} = 25,$$

$G_{92}=20$, $G_{93}=20$, $G_{94}=60$, $G_{95}=26$, $G_{97}=16$, $G_{98}=15$, $G_{102}=20$, $G_{103}=20$, $G_{107}=20$, the transport rollers 30, 31 and the press rollers 37, 37 are rotated at a higher speed of 1,277 rpm when the bill accumulating portion 12 faces the outlet portion of the bill dispensation passage 7 for taking the bills B into the bill accumulating portion 12 and, on the other hand, are rotated at a lower speed of 52.3 rpm when the bill accumulating portion 12 faces the opening 16 of the first bill dispensation box 4 for collecting the bills B into the bill collecting section 4*b*. Further, when the drum 3 is rotated for changing the position of the bill accumulating portion 12, the drum 3 is rotated at a lower speed of 18.04 rpm, and the position of tho bill accumulating portion 12 is changed to face the outlet portion of the bill dispensation passage 7, the bill dispensation opening 2 or the opening 16 of the first bill dispensation box 4.

In the thus constituted bill dispensing machine which is an embodiment of the present invention, when the actuating plate 60 is positioned at the photo interruptor 61 and turns the photo interruptor 61 off by intercepting light emitted from the light emitter, a control means (not shown) judges that the bill accumulating portion 12 of the drum 3 faces the outlet portion of the bill dispensation passage 7 and outputs a control signal for turning the solenoid off and a control signal for turning the solenoid 108 on. As a result of turning the solenoid 112 off, the lock pin 111 engages with one of the engaging members 44 formed on the circumference of the one of the disks 9, 9 and presses the press member 121*a* of the lock member 121 to release the engagement between the engaging member 121*b* of the lock member 121 and the planetary gear 92. Simultaneously, the solenoid 108 is turned off and the intermediate gear 107 engages with the wide gear 95. Further, since the cam follower 73 abuts against the plate-like cam 70 under its dead load, the press plate 11 is movable from the position close to the bottom plate 10 shown in FIG. 4 to the position apart from the bottom plate 10 shown in FIG. 3. On the other hand, the press rollers 37, 37 are held as spaced apart from the bottom plate 10, since the cam follower 74 is positioned as shown in FIG. 9. Further, the shutter plate 52 is positioned by the stay 54 and the shutter lock arm 57 to close the bill dispensation opening 2.

Under these conditions, when driving force is input to the pulley 101 from the motor 14, the large-diameter gear 94 and the wide gear 95 are rotated and the sun gears 90, 91 are rotated at $N_1$ rpm calculated by the formula (1). In this case, since $n_2$ is not zero, the absolute value of $N_1$ is larger. Further, since the the engagement between the planetary gear 92 and the engaging member 121*b* of the lock member 121 is released, the transport roller shaft 28 is rotated at $N_2$ rpm calculated by the formula (2) and the shaft 41 is rotated at $N_3$ rpm calculated by the formula (3). As a result, in FIGS. 3, 4 and 11, the transport rollers 30, 31 are rotated counterclockwise and the press rollers 37, 37 are rotated clockwise at the higher speed.

Accordingly, the bills B fed to the bill accumulating portion 12 from the bill dispensation passage 7 are further slippingly fed onto the upper face of the sloped portion 10*a* into the bill accumulating portion 12, and when they come into contact with the transport rollers 30, 31, they are taken into the bill accumulating portion 12 at the higher speed. As described above, since the rear edge of each bill B fed out from the bill dispensation passage 7 is lifted up by a vane 130*a* of the vaned wheel 130 and the following bill B is then fed to the bill accumulating portion 12, the following bill B is fed beneath the preceding bill B and the bills B are thus accumulated in the bill accumulating portion 12. Under these conditions, since the press plate 11 is movable, the press plate 11 is pushed up by the bills B fed into and accumulated in the bill accumulating portion 12 and is moved from the position shown in FIG. 4 to the position shown in FIG. 3.

Thus, the bill receiving and accumulating operation is completed when the discriminating means 8 detects that a predetermined number of bills B have been fed into the bill accumulating portion 12.

Then, the control means outputs a bill dispensation signal and the drum 3 is rotated to the position where the bill accumulating portion 12 faces the bill dispensation opening 2.

More specifically, the solenoid 112 is turned on and the engagement between the lock pin 111 of the lock arm 110 and the engaging member 44 of the disk 9 is released. As a consequence, the press member 121*a* of the lock member 121 is not pressed by the lock pin 111 and the lock member 121 is swung counterclockwise about the shaft 120, whereby the engaging member 121*b* engages with the planetary gear 92 and prevents it from rotating. Simultaneously, the solenoid 108 is turned off and the lock arm 105 is swung counterclockwise, whereby the lock lever 104 engages with the notch 95*a* of the wide gear 95 and prevents it from rotating.

Under these conditions, when driving force is input to the pulley 101 from the motor 14, since the wide gear 95 is locked, $n_2$ is zero and the sun gears 90, 91 are rotated at the lower rpm $N_1$ calculated by the formula (1). However, since the planetary gear 92 is locked, the drum 3 is rotated counterclockwise at the lower rpm $N_1$ in accordance with the rotation of the sun gears 90, 91 and is moved from the position shown in FIG. 3 to the position where the bill accumulating portion 12 faces the bill dispensation opening 2.

In accordance with the rotation of the drum 3, the release pins 59, 59 provided on the outer faces of the pair of disks 9, 9 in the vicinity of the circumference thereof abut against the sloped portions 57*b*, 57*b* formed on the shutter lock arms 57, 57 respectively and push the shutter lock arms 57, 57 away so that the shutter lock arms 57, 57 are swung counterclockwise about the lock arm shaft 56 to release the engagement between the left edge of the shutter plate 52 (FIG. 5) and the notches 57*a* of the shutter lock arms 57, 57, whereby the shutter plate becomes swingable counterclockwise about the center shaft 15. On the other hand, the shutter press members 55, 55 provided on the circumferences of the pair of disks 9, 9 abut against the right edge of the shutter plate 52 (FIG. 5) and swing the shutter plate 52 counterclockwise about the center shaft 15 in FIG. 5 against the tensile force of the tension spring 53. Accordingly, under the condition where the bill accumulating portion 12 of the drum 3 faces the bill dispensation opening 2, the shutter plate 52 retracts from the position where it covers the bill dispensation opening 2, whereby the bill dispensation opening 2 becomes exposed to the outside of the bill dispensing machine 1.

On the other hand, the press plate 11 is moved as spaced apart from the bottom plate 10 by the moment about the shaft 22 of the first arm 24 and is held there. Although the cam follower 74 rotates clockwise along the lobe of cam 71 in FIG. 9, since the shape of the lobe of the cam 71 is determined such that the distance between itself and the center shaft 15 is substantially constant by this rotation of the cam follower 74, the press rollers 37, 37 is held apart from the bottom plate 10.

Figure 15:
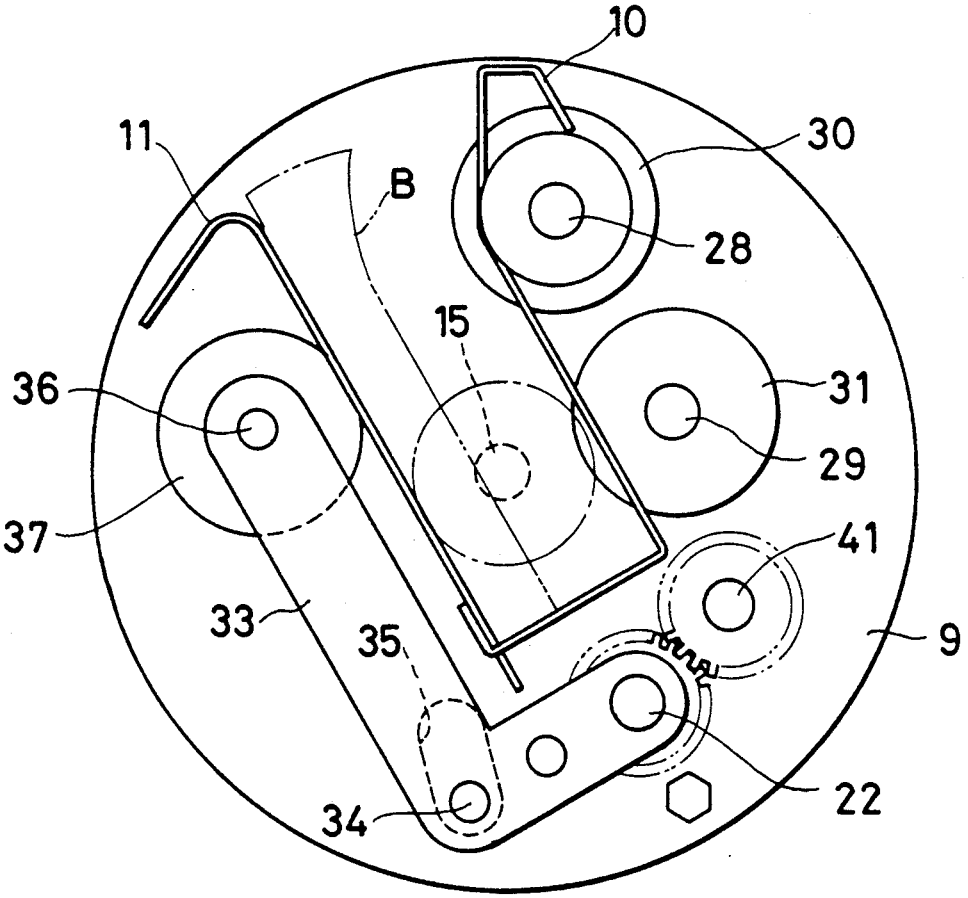
FIG. 15 is a schematic drawing showing a left side view of the drum shown in FIG. 2 with a left side disk removed and a bill accumulating portion facing a bill dispensing opening.

FIG. 15 shows the drum 3 in the case where the its bill accumulating portion 12 is positioned to face the bill dispensation opening 2. This condition is detected by the photo interruptor 62 and the control means (not shown) stops the operation of the motor 14 and turns the solenoid 112 off, thereby to engage the lock pin 111 of the lock arm 110 with the engaging member 44 of the disk 9 and hold the drum 3 at the position shown in FIG. 15.

Then, when all of the bills B accumulated in the bill accumulating portion 12 have been taken out by the customer and the photosensor 43 detects that no bill is present in the bill accumulating portion 12, the control means rotates the motor reversely until the photo interruptor 61 detects that the bill accumulating portion 12 is positioned to face the outlet portion of the bill dispensation passage 7. Thus, at the time when the bill accumulating portion 12 returns to the position where it faces the outlet portion of the bill dispensation passage 7, the shutter plate 52 closes the bill dispensation opening 2 again and the inside and the outside of the bill dispensing machine is interrupted by the shutter plate 52.

So long as the discriminating means does not detect any abnormality of the bills B, the above described bill receiving and accumulating operation and bill dispensing operation are repeated.

When the discriminating means detects double feed of bills B, the presence of bills having a different denomination from the predetermined one or other abnormality, it outputs an abnormal signal to the control means (not shown) and the control means starts the bill collection operation for collecting the bills B into the bill collecting section **4*b* of the first bill dispensation box 4 after the abnormal bills are accumulated in the bill accumulating portion 12**.

More specifically, the engagement between the lock pin 111 of the lock arm 110 is released by turning the solenoid 112 on, thereby to enable the drum 3 to rotate, and at the same time, the engaging member **121*b* of the lock member 121 engages with the planetary gear 92 by preventing the lock pin 111 from pressing the press member 121*a* of the lock member 121. Further, the lock lever 104 engages with the notch 95*a* of the wide gear 95 by turning the solenoid 108 off to prevent the wide gear 95 from rotating and the drum 3 is rotated and positioned by the motor 14 so that its bill accumulating portion 12 faces the bill collecting section 4*b* of the first bill dispensation box 4. In accordance with such rotation of the drum 3, the cam followers 73, 74 are rotated and moved counterclockwise along the lobes of the plate-like cams 70, 71, whereby the press plate 11 comes close to the bottom plate 10 by the moment about the shaft 22 of the first arm 24 and the press rollers 37, 37 also come close to the bottom plate 10 by the movement of the cam follower 74. As a result, the bills B are held between the transport rollers 30, 31 and the press rollers 37, 37**.

Figure 16:
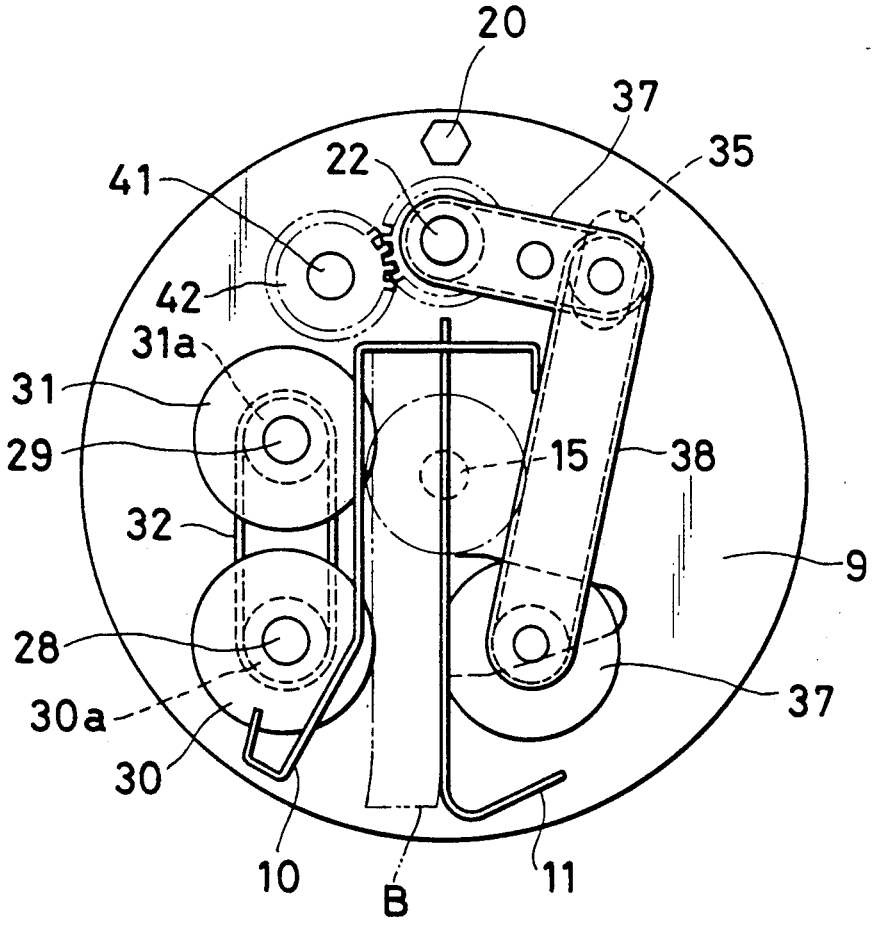
FIG. 16 is a schematic drawing showing a left side view of the drum shown in FIG. 2 with a left side disk removed and a bill accumulating portion facing a bill collecting section.

Thus, as shown in FIG. 16, when the photo interruptor 63 detects that the drum 3 has been rotated so that the bill accumulating portion 12 faces downward toward the bill collecting section **4*b* of the first bill dispensation box 4, the solenoid 112 is turned off and the lock pin 111 of the lock arm 110 engages with the engaging member 44 of the disk 9 to press the press member 121*a* of the lock member 121, whereby the engagement between the engaging member 121*b* of the lock member 121 and the planetary gear 92 is released and the planetary gears 92 and 93** rotate.

However, under these conditions, since the wide gear 95 is locked by the lock lever 104 of the lock arm 105 and $n_2$ is zero, the absolute value of $N_1$ calculated by the formula (1) is small, whereby $N_2$ and $N_3$ at which the planetary gears rotate are also small. Accordingly, the planetary gears 92, 93 are rotated at a lower speed by the motor 14 rotating reversely and the transport rollers 30, 31 and the press rollers 37, 37 feed the bills B held therebetween into the bill collecting section **4*b* of the first bill dispensation box 4 via the opening 16** for collection.

Thus, when the photosensors 43 detect that all of the bills B accumulated in the bill accumulating portion 12 have been collected by the bill collecting section **4*b*, the solenoid 112 is turned on again and the motor 14 is rotated in the regular direction, whereby the drum 3 is returned so that the bill accumulating portion 12 faces the outlet portion of the bill dispensation passage 7**.

According to the above described embodiment, since the bills B to be dispensed can be accumulated in the bill accumulating portion 12 by only the drum 3, and the dispensation or collection of the accumulated bills B can be conducted by only positioning the drum 3 so that the bill accumulating portion 12 faces the bill dispensation opening 2 or that the bill accumulating portion 12 faces the bill collecting section **4*b*, it is not necessary to provide a switching means for selectively switching the bill transport passages in addition to the bill accumulating portion 12** or to provide a bill transport passage from the bill accumulating portion to the switching means. Thus the bill dispensing machine can be made more compact.

Figure 17:
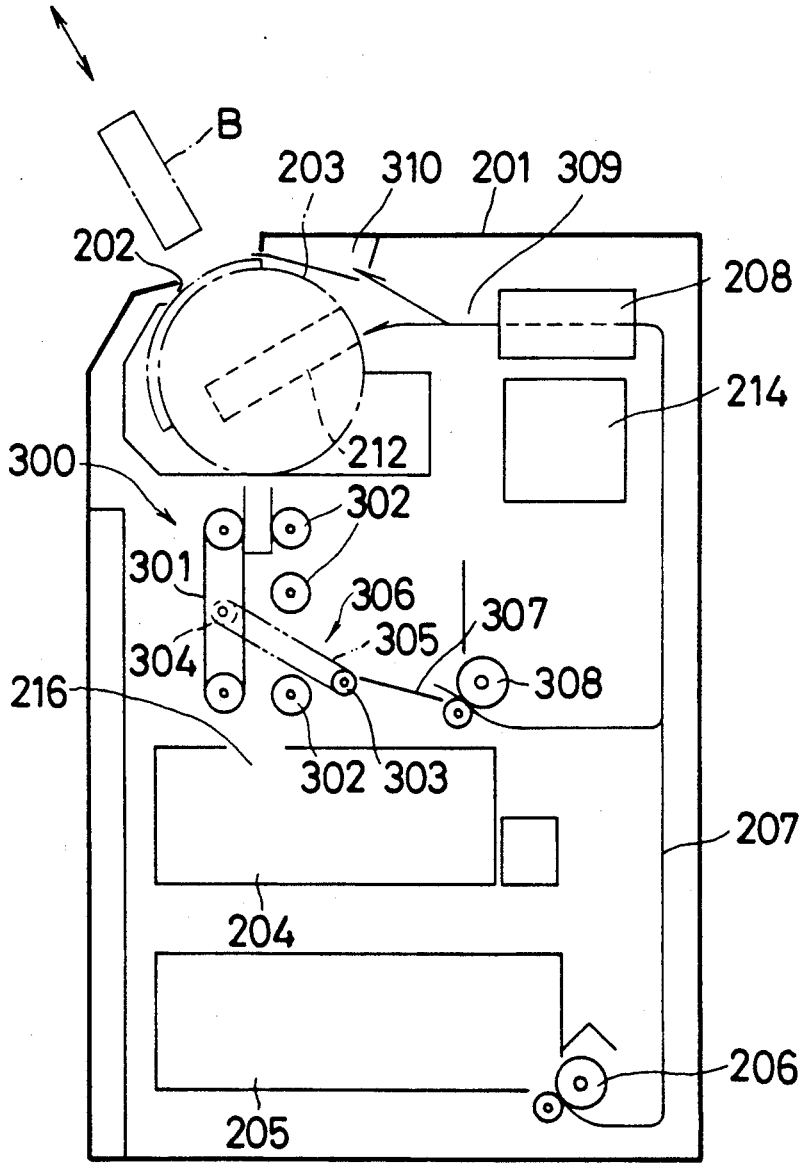
FIG. 17 is a schematic drawing showing a mechanism of a bill receiving and dispensing machine which is another embodiment of the present invention.

FIG. 17 is a schematic drawing showing a mechanism of a bill receiving and dispensing machine which is another embodiment of the present invention.

The bill receiving and dispensing machine 201 shown in FIG. 17 is capable of receiving and dispensing bills B. A drum 203 is disposed in the vicinity of the bill receiving and dispensing opening 202 for receiving bills B into the machine 201 and dispensing bills B from the machine 201. The reference numeral 214 designates a motor serving as a power source.

Since the drum 203 has the same structure as that of the drum 3 described in the previous embodiment, the structure thereof is omitted in FIG. 17 and the operation for dispensing bills B is the same as that in the previous embodiment. More specifically, the bills contained in a bill dispensation box 205 are taken out one by one from the bill dispensation box 205 by a bill take-out mechanism 206 and fed to a discriminating means 208 via a bill transport passage 207 where double feed of bills, the presence of bills having a different denomination from the predetermined one or other abnormality is detected. When no abnormality is detected, the bills B are fed into a bill accumulating portion 212 of the drum 203, which is positioned to face the outlet portion of the bill transport passage 207 and accumulated therein in the same manner as in the previous embodiment. Then, the drum 203 is rotated so that the bill accumulating portion 212 faces the bill receiving and dispensing opening 202 and the bills B accumulated in the bill accumulating portion 212 are dispensed to the customer via the bill receiving and dispensing opening 202 in the same manner as in the previous embodiment. On the other hand, in the case where some abnormality is detected by the discriminating means 208, after the abnormal bills B have been accumulated in the bill accumulating portion 212, the drum 203 is rotated so that the bill accumulating portion 212 faces downward and the bills B are collected in the same manner as in the previous embodiment. However, in this embodiment, since the machine 201 is capable of receiving bills B, there are provided below the drum 203 a bill receiving mechanism 300 and a bill receiving box 204, and the received bills B are collected by the bill receiving box 204 via the bill receiving mechanism 300.

When receiving bills B, the drum 203 is positioned such that the bill accumulating portion 212 faces the bill receiving and dispensing opening 202 and after the receive bills B have been accumulated in the bill accumulating portion 212, the drum 203 is rotated so that the bill accumulating portion 212 faces downward, whereby the bills B are fed out to the bill receiving mechanism 300 disposed below the drum 203.

The bill receiving mechanism 300 comprises an endless belt 301 for transporting bills B substantially vertically, a plurality of transport rollers 302 facing the endless belt 301 and arranged along a bill transporting path defined by the endless belt 301, a bifurcation transport belt 306 consisting of rollers 303, 304 and an endless belt 305, the bifurcation transport belt 306 being swingable about the roller 303, a holding plate 307 for holding bills B fed out from the bifurcation transport belt 306 thereon, and a bill separating means 308 for taking the bills B held on the holding plate 307 off the holding plate 307 one by one and feeding them to the discriminating means 208 via the bill transport passage 207.

In the thus constituted bill receiving and dispensing machine 201, when receiving bills B, the bills B accumulated in the bill accumulating portion 212 of the drum 203 are fed from the bill accumulating portion 212 to a portion between the endless belt 301 and the plurality of transport rollers 302 and since the bifurcation transport belt 306 is swung about the roller 303 so that the roller 304 and the endless belt 305 are positioned in the bill transporting path formed between the endless belt 301 and the plurality of transport rollers 302 under the condition, the bills B transported being held between the endless belt 301 and the plurality of transport rollers 302 are led onto the endless belt 305 of the bifurcation transport belt 306 to be placed onto the holding plate 307. The bills B placed on the holding plate 307 are fed to the bill transport passage 207 one by one by the bill take-out mechanism 308 and are further counted and their genuineness is discriminated by the discriminating means 208. When the bills B are discriminated as counterfeit, they are separated from the genuine bills B by a switching means 309 in a well known manner and fed to the return opening 310 to be returned to the customer. On the other hand, when the bills B are discriminated as genuine, the bills B are fed to and accumulated in the bill accumulating portion 212 of the drum 3, which faces the outlet portion of the bill transport passage 207 in the same manner as that described in connection with the accumulating operation of the bills B to be dispensed in the previous embodiment. Afterwards, as well known in the art, the amount (value) of the received bills is displayed by the machine 201 and if the customer instructs the machine to accept the bills B, the bills B accumulated in the bill accumulating portion 212 are fed to the bill receiving box 204, and, to the contrary, if the customer instructs the machine to return the bills B, the bills B accumulated in the bill accumulating portion 212 are returned to the customer via the bill receiving and dispensing opening 202. More specifically, when the customer instructs the machine to accept the bills B, the drum 203 is rotated so that the bill accumulating portion 212 faces downward, that is, toward the bill receiving mechanism 300 and the bills B are transported as held between the endless belt 301 and the plurality of the transport rollers 302 again. In such a case where the customer instructs machine to accept the bills B, since the bifurcation transport belt 306 is swung about the roller 303 so that the roller 304 and the endless belt 305 retract from the bill transporting path formed between the endless belt 301 and the plurality of transport rollers 302, the bills B are accepted by the bill receiving box 204 via an opening 16 thereof. To the contrary, when the customer instructs the machine to return the bills B, the drum 203 is rotated so that the bill accumulating portion 212 faces the bill receiving and dispensing opening 202 and the bills B accumulated in the bill accumulating portion 212 are taken out from the bill accumulating portion 212 in the same manner as was described in connection with the bill dispensation operation in the previous embodiment.

According to this embodiment, since the bills B received or to be dispensed can be accumulated in the bill accumulating portion 212 by only the drum 203, the accumulated bills B can be received and collected by only positioning the drum 3 so that the bill accumulating portion 212 faces the bill receiving mechanism 300 and the received and accumulated bills B to be returned can be returned to the customer by only positioning the drum 203 so that the bill accumulating portion 12 faces the bill receiving and dispensing opening 202, it is not necessary to provide a switching means for selectively switching the bill transport passages for transporting the received bills B or a switching means for selectively switching the bill transporting passage for transporting the bills to be dispensed in addition to the bill accumulating portion 12, or to provide bill transport passages from the bill accumulating portion to the switching means. The bill receiving and dispensing machine 201 can thus be made more compact.

Figure 18:
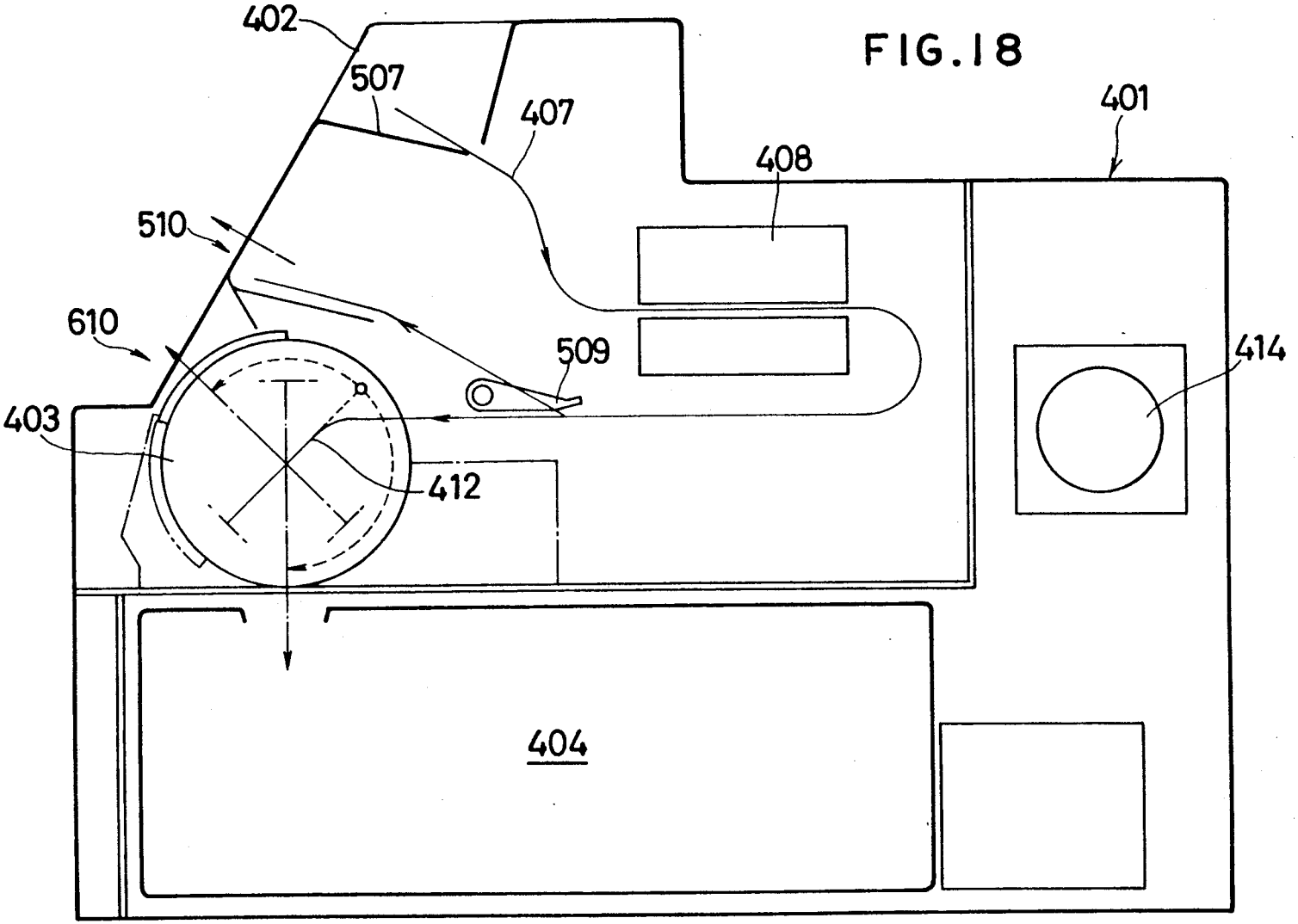
FIG. 18 is a schematic drawing showing a mechanism of a bill receiving machine which is a further embodiment of the present invention.

FIG. 18 is a schematic drawing showing a mechanism of a bill receiving machine which is another embodiment of the present invention.

Referring to FIG. 18, the bill receiving machine 401 has a bill receiving opening 402 at an upper portion thereof and there are provided in the vicinity of the bill receiving opening 402 a holding plate 507 for holding bills B deposited via the bill receiving opening 402 thereon and a bill separation and feeding mechanism (not shown) for separating the bills B placed on the holding plate 507 one by one and feeding them to a bill transport passage 407. The bills B fed to the bill transport passage 407 by the bill separation and feeding mechanism are counted and discriminated as to whether or not they are acceptable, for example, as to whether they are genuine by a discriminating means 408. Bills B discriminated as unacceptable are fed to a first bill return opening 510 by a switching means 509 to be returned to the customer in a well known manner. On the other hand, the bills B discriminated as acceptable are fed to a bill accumulating portion 412 of a drum 403. The drum 403 is the same as that in the embodiment shown in FIGS. 1 to 16 and, therefore, its structural details are omitted in FIG. 18. In FIG. 18, the reference numeral 414 designates a motor serving as a power source.

When receiving bills B, the drum 403 is positioned such that the bill accumulating portion 412 faces the outlet portion of the bill transport passage 407 and the bills B deposited are received by and accumulated in the bill accumulating portion 412 in the same manner as described in connection with the accumulating operation for accumulating the bills B to be dispensed in the embodiment shown in FIGS. 1 to 16. After the bills B have been accumulated in the bill accumulating portion 412, the value of the bills B counted by the discriminating means 408 is displayed as well known in the art and when the customer instructs the machine to accept the bills B, the drum 403 is rotated so that the bill accumulating portion 412 faces downward, that is, toward an opening 416 of a bill receiving box 404 disposed below the drum 403 and the bills B accumulated in the bill accumulating portion 412 are fed into the bill receiving box 404 in the same manner as that described in connection with collection of the bills B by the bill collecting box **4*b* in the embodiment shown in FIGS. 1 to 16. On the other hand, when the customer instructs the machine to return the bills B, the drum 403 is rotated so that the bill accumulating portion 412 faces a second bill return opening 610 disposed with the same positional relationship relative to the drum 403 as that between the drum 3 and the bill dispensation opening 2 and the bills B accumulated in the bill accumulating portion 412 are returned to the customer via the second bill return opening 610 in the same manner as described in connection with the operation for dispensing the bills B accumulated in the bill accumulating portion 12 in the embodiment shown in FIGS. 1 to 16**.

According to this embodiment, since the received bills B can be accumulated in the accumulating portion only by use of the drum 403 and the bill receiving operation for receiving the bills B deposited or the bill return operation for returning the bills B to the customer can be conducted by only positioning the drum 403 so that the bill accumulating portion faces the bill receiving box 404 or the second bill return opening 610, it is not necessary to provide a switching means for selectively switching the bill transport passage for transporting the received bills B in addition to the bill accumulating portion 412 or to provide a bill transport passage from the bill accumulating portion 412 to the switching means. The bill receiving machine 401 can thus be made more compact.

As described in detail with reference to the preferred embodiments, according to the present invention, it is possible to provide a bill processing apparatus capable of receiving and/or dispensing bills that is more compact and simple.

The present invention has thus been shown and described with reference to the specific embodiments. However, it should be noted that the present invention is in no way limited to the details of the described arrangements but changes and modifications may be made without departing from the scope of the appended claims.

For example, in the above described embodiments, although when the rotation of the drum 3, 203 or 403 is to be started, the solenoid 112 is turned on and the engagement between the lock pin 111 of the lock arm 110 and the engaging member 44 of the one of the disks 9, 9 is released, whereby the the drum 3, 203 or 403 becomes rotatable, and the solenoid 112 is turned off, thereby to engage the lock pin 111 of the lock arm 110 with the engaging member 44 of the disk 9 at the time when the drum 3, 203 or 403 is rotated and positioned at a predetermined position, if the solenoid 112 is turned on, thereby to release the engagement between the lock pin 111 and the engaging member 44 of the disk 9 when the rotation of the drum 3, 203 or 403 is to be started, the solenoid 112 may be turned off after the rotation of the drum 3, 203 or 403 has been started but before the drum 3, 203 or 403 has been rotated to the predetermined position.

Further, although in the embodiment shown in FIGS. 1 to 16, two bill dispensation boxes 4, 5 are provided and in the embodiment shown in FIG. 17, only one bill dispensation box 205 is provided, the number of the bill dispensation boxes is arbitrary and a plurality of bill dispensation boxes containing bills having different denominations from each other can of course be provided.

Moreover, in the above described embodiments, although only one bill receiving box 204, 404 is provided, a plurality of bill receiving boxes may be provided for discriminating the denomination of the received bills and storing bills in respective bill receiving boxes in accordance with their denominations or storing bills having a predetermined denomination in a separate bill receiving box.

We claim:

1. A bill processing apparatus capable of receiving and/or dispensing bills, said bill process apparatus comprising drum means disposed in the vicinity of a bill transaction opening capable of communicating between the outside and inside of the bill processing apparatus and secured to a center shaft rotatably mounted on said bill processing apparatus, said drum means having a bill accumulating means which has a bill-receiving opening at one side thereof and can receive the bills via said bill-receiving opening and accumulate them therein, bill feed-in passage means for feeding the accumulated bills from said bill accumulating means into the inside of the bill processing apparatus, bill feed-out passage means for feeding the bills one by one from the inside of the bill processing apparatus to said bill accumulating means, drum rotating means for rotating said drum means so that said bill-receiving opening of said bill accumulating means can selectively communicate with the bill transaction opening, the bill feed-in passage means or the bill feed-out passage means, and bill transporting means provided for said bill accumulating means and capable of feeding the bills one by one into said bill accumulating means at a first speed and feeding out the accumulated bills from said bill accumulating means at a second speed, said first speed being faster than said second speed.

2. A bill processing apparatus in accordance with claim 1, further comprising motor means for producing a driving force to drive said bill transporting means and a gear mechanism for transmitting the driving force produced by the motor means to said bill transporting means so that the bills are fed one by one into said bill accumulating means at the first speed and the accumulated bills are fed out from the said bill accumulating means at the second speed.

3. A bill processing apparatus in accordance with claim 1, further comprising motor means for producing a driving force to drive said drum rotating means and said bill transporting means and a driving force transmitting means for selectively transmitting the driving force produced by the motor means to said drum rotating means or said bill transporting means.

4. A bill processing apparatus capable of receiving and dispensing bills, said bill processing apparatus comprising a bill receiving and dispensing opening capable of communicating the outside and inside of the bill processing apparatus so as to be able to receive and dispense the bills therethrough, drum means disposed int he vicinity of said bill receiving and dispensing opening and secured to a center shaft rotatably mounted on said bill processing apparatus, said drum means having a bill accumulating means which has a bill-receiving opening at one end thereof and can receive the bills via said bill-receiving opening and accumulate them therein, at least one bill receiving box for storing the bills deposited into the bill processing apparatus via said bill receiving and dispensing opening, at least one bill dispensation box for holding the bills to be dispensed, bill feed-in passage means for feeding the accumulated bills from said bill accumulating means into said at least one bill receiving box, bill feed-out passage means for feeding the bills one by one from said at least one bill dispensation box to said bill accumulating means, bill feed-out means retractable from said bill feed-in passage means for receiving the bills deposited into the bill processing apparatus via said bill receiving and dispensing opening and being transported in said bill feed-in passage means from said bill feed-in passage means and feeding them to said bill feed-out passage means, discriminating means capable of counting the bills and discriminating at least double feed of bills, denomination of bills and whether or not the bills are acceptable and disposed in said bill feed-out passage means downstream of the portion where the bills are fed from said bill feed-out means, reject means bifurcated from said bill feed-out passage means downstream of the discriminating means for separating the bills discriminated as unacceptable by said discriminating means from said bill feed-out passage means, a bill return opening for returning the bills separated by said reject means to the outside of the bill processing apparatus, drum rotating means for rotating said drum means so that said opening of the bill accumulating means can selectively communicate with said bill receiving and dispensing opening, said bill feed-in passage means or said bill feed-out passage means, and bill transporting means provided for said bill accumulating means and capable of feeding the bills one by one into said bill accumulating means at a first speed and feeding out the accumulated bills from said bill accumulating means at a second speed, said first speed being faster than said second speed.

5. A bill processing apparatus in accordance with claim 4, further comprising motor means for producing a driving force to drive said bill transporting means and a gear mechanism for transmitting the driving force produced by the motor means to said bill transporting means so that the bills are fed one by one into said bill accumulating means at the first speed and the accumulated bills are fed out from said bill accumulating means at the second speed.

6. A bill processing apparatus in accordance with claim 4, further comprising motor means for producing a driving force to drive said drum rotating means and said bill transporting means and a driving force transmitting means for selectively transmitting the driving force produced by the motor means to said drum rotating means or said bill transporting means.

* * * * *